US012650237B2

(12) United States Patent
Hirano

(10) Patent No.: US 12,650,237 B2
(45) Date of Patent: Jun. 9, 2026

(54) DEVICE CONTROL SYSTEM

(71) Applicant: Mitsubishi Electric Corporation, Tokyo (JP)

(72) Inventor: Makoto Hirano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 319 days.

(21) Appl. No.: 18/546,324

(22) PCT Filed: Apr. 2, 2021

(86) PCT No.: PCT/JP2021/014396
§ 371 (c)(1),
(2) Date: Aug. 14, 2023

(87) PCT Pub. No.: WO2022/208891
PCT Pub. Date: Oct. 6, 2022

(65) Prior Publication Data

US 2024/0133571 A1 Apr. 25, 2024
US 2024/0230132 A9 Jul. 11, 2024

(51) Int. Cl.
*F24F 11/58* (2018.01)
*F24F 11/52* (2018.01)

(52) U.S. Cl.
CPC ..... *F24F 11/58* (2018.01); *F24F 11/52* (2018.01)

(58) Field of Classification Search
CPC . F24F 11/58; F24F 11/52; F24F 11/56; G08C 2201/20; G08C 2201/93; G08C 17/02; H04M 11/007
See application file for complete search history.

(56) References Cited

U.S. PATENT DOCUMENTS

2018/0083799 A1 3/2018 Draaijer et al.
2018/0305851 A1* 10/2018 Kwon ..... H04L 12/2825
(Continued)

FOREIGN PATENT DOCUMENTS

AU 2016434810 B2 6/2020
EP 3373528 A1 9/2018
(Continued)

OTHER PUBLICATIONS

Extended European Search Report mailed Apr. 4, 2024 in corresponding European Patent application No. 21935052.7.
(Continued)

*Primary Examiner* — Charles R Kasenge
(74) *Attorney, Agent, or Firm* — Posz Law Group, PLC

(57) ABSTRACT

A device control system includes: a wireless device including a device to be controlled and external connector that is connected to the device to be controlled, transmits/receives information to/from the device to be controlled, and is wirelessly connected to a wireless LAN router; a handheld operation terminal that includes a display unit for displaying information and operates the device to be controlled; and a wireless operation terminal that is a terminal different from the handheld operation terminal and operates the device to be controlled via the external connector. When the wireless device receives, from the handheld operation terminal, an information acquisition request for first information that is information necessary for connecting the wireless operation terminal to the external connector, the wireless device selectively transmits the first information to the handheld operation terminal, and the display unit displays the first information.

16 Claims, 27 Drawing Sheets

(56) References Cited

U.S. PATENT DOCUMENTS

| | | | | |
|---|---|---|---|---|
| 2019/0052476 | A1* | 2/2019 | Shu | H04W 4/70 |
| 2019/0289648 | A1* | 9/2019 | Kim | H04L 12/2809 |

FOREIGN PATENT DOCUMENTS

| | | | |
|---|---|---|---|
| EP | 3 373 528 | B1 | 11/2019 |
| JP | 2018-509739 | A | 4/2018 |
| WO | 2015/111178 | A1 | 7/2015 |

OTHER PUBLICATIONS

Office Action mailed Apr. 18, 2024 in corresponding Australian Patent application No. 2021437956.
International Search Report of the International Searching Authority mailed Jun. 8, 2021, issued in corresponding International Application No. PCT/JP2021/014396 (and English machine translation).
Office Action mailed Mar. 28, 2026 for corresponding Chinese Patent Application No. 202180095024.8 (and partial English machine translation).

* cited by examiner

| DEVICE | INDOOR MODE | OUTDOOR MODE | MODE SWITCHING METHOD |
|---|---|---|---|
| EXTERNAL CONNECTOR | (1)INDOOR COMMUNICATION ONLY | (2)INDOOR COMMUNICATION AND (3)OUTDOOR COMMUNICATION | SWITCH BY OPERATION TERMINAL OR BY USING SWITCH ON EXTERNAL CONNECTOR |
| OPERATION TERMINAL | (4)INDOOR COMMUNICATION ONLY | (5)OUTDOOR COMMUNICATION ONLY | AUTOMATIC SWITCH (BY RADIO) |

| | |
|---|---|
| 7 | APPLICATION LAYER |
| 6 | PRESENTATION LAYER |
| 5 | SESSION LAYER |
| 4 | TRANSPORT LAYER(UDP) |
| 3 | NETWORK LAYER(IP ADDRESS) |
| 2 | DATA LINK LAYER(MAC) |
| 1 | PHYSICAL LAYER |

FIG.15

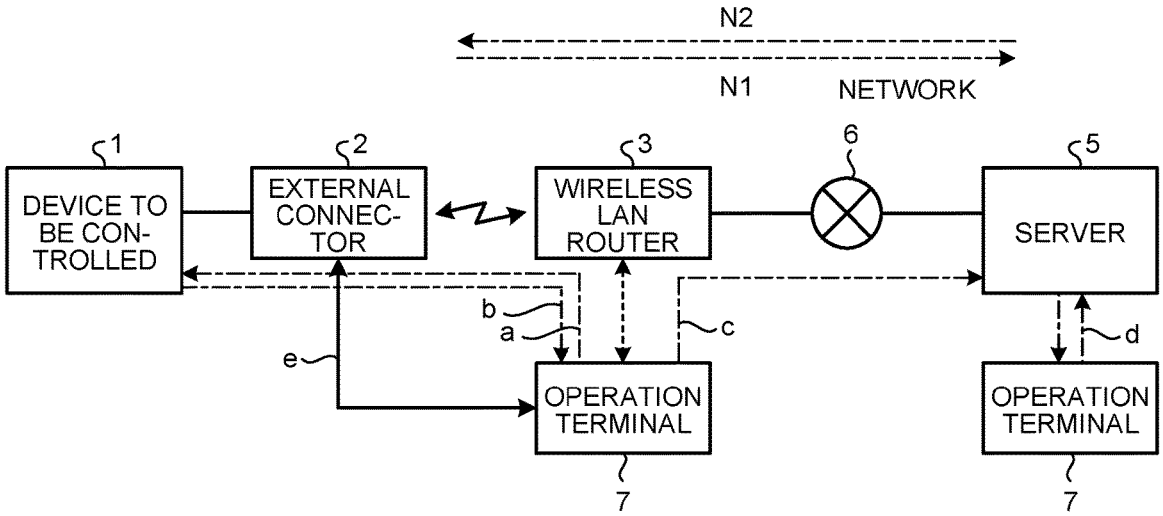

FIG.16

| DEVICE | CONNECTION MODE | | MODE SWITCHING METHOD |
|---|---|---|---|
| | ROUTER CONNECTION MODE | TERMINAL CONNECTION MODE | |
| EXTERNAL CONNECTOR | CONNECTED TO ROUTER | DIRECTLY CONNECTED TO OPERATION TERMINAL | SWITCH USING SWITCH ON EXTERNAL CONNECTOR |
| OPERATION TERMINAL | CONNECTED TO ROUTER | DIRECTLY CONNECTED TO EXTERNAL CONNECTOR | ·SWITCH MANUALLY ON OPERATION TERMINAL<br>·CONNECT AUTOMATICALLY BASED ON CONNECTION HISTORY |

DEVICE CONTROL SYSTEM

CROSS-REFERENCE TO RELATED APPLICATION

This application is a U.S. national stage application of International Application No. PCT/JP2021/014396 filed on Apr. 2, 2021, the contents of which are incorporated herein by reference.

TECHNICAL FIELD

The present disclosure relates to a device control system.

BACKGROUND

In a device control system that operates a device to be controlled installed indoors via a network, a device to be controlled newly purchased by a user needs to be connected to the network. Patent Literature 1 discloses a method of displaying, on a remote control, registration information necessary for connecting a device to be controlled to a mobile terminal or a server.

In the method of displaying the registration information on the remote control disclosed in Patent Literature 1, when an operation unit of the remote control issues an instruction to present the registration information, a control unit acquires the registration information and causes a display unit to present the registration information. At this time, a registration information presentation unit of the control unit presents the registration information, which is acquired by a registration information acquisition unit of the control unit, in a format such as text, a symbol, or a barcode that can be read and converted into the original registration information by the mobile terminal.

PATENT LITERATURE

Patent Literature 1: International Publication No. WO 2015/111178

However, in the method of displaying the registration information on the remote control disclosed in Patent Literature 1, communication information necessary for connecting a communication device and the mobile terminal and target information necessary for specifying an air conditioner are not displayed separately but are presented together on the remote control. Therefore, when the number of pieces of information increases, a space for presenting each piece of information decreases, causing a problem that text information is small and less legible.

SUMMARY

The present disclosure has been made in view of the above, and an object thereof is to provide a device control system capable of displaying only necessary information on a display unit according to the situation.

In order to solve the above problem and achieve the object, a device control system according to the present disclosure is a device control system including: a wireless device including a device to be controlled and an external connector to be connected to the device to be controlled, transmit/receive information to/from the device to be controlled, and be wirelessly connected to a wireless LAN router; a handheld operation terminal to operate the device to be controlled, the handheld operation terminal including a display unit to display information; and a wireless operation terminal to operate the device to be controlled via the external connector, the wireless operation terminal being a terminal different from the handheld operation terminal. The wireless device selectively transmits first information to the handheld operation terminal when receiving, from the handheld operation terminal, an information acquisition request for the first information that is information necessary for connecting the wireless operation terminal to the external connector, and the display unit displays the first information.

The device control system according to the present disclosure has an effect of being able to display only necessary information on the display unit according to the situation.

BRIEF DESCRIPTION OF DRAWINGS

FIG. 15 is a diagram for describing communication modes featured in the embodiment.

FIG. 16 is a table illustrating a method of switching a connection mode of each of the external connector and the operation terminal to a router connection mode or a terminal connection mode, and a connection state of each of the external connector and the operation terminal.

DETAILED DESCRIPTION

Hereinafter, a device control system according to an embodiment will be described in detail with reference to the drawings.

Embodiment

Figure 1:
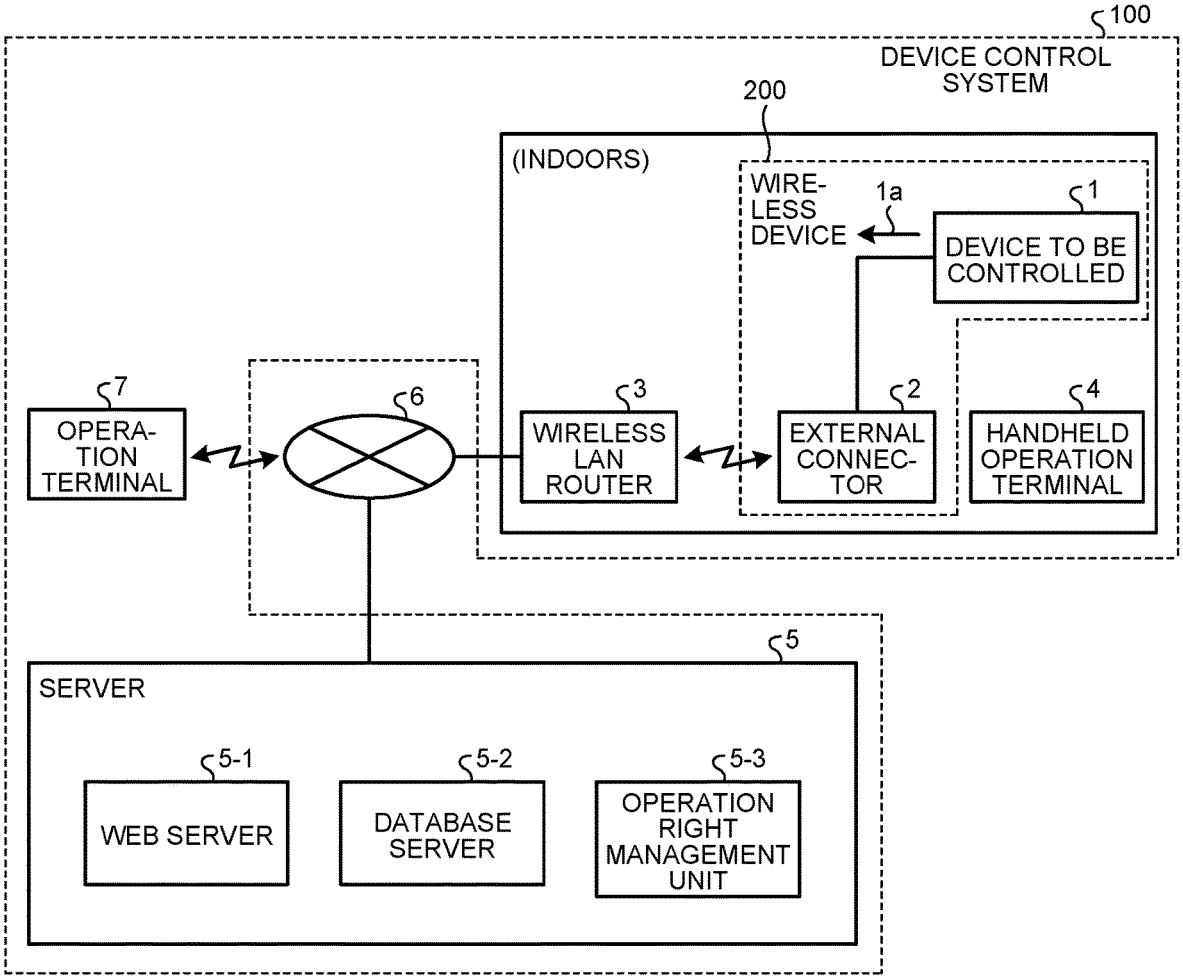
FIG. 1 is a diagram schematically illustrating a device control system according to an embodiment.

FIG. 1 is a diagram schematically illustrating a device control system according to the present embodiment. A device control system 100 includes a wireless device 200, a wireless LAN router 3, a handheld operation terminal 4, a server 5, and an operation terminal 7.

The wireless device 200 includes a device to be controlled 1 and an external connector 2. The server 5 is connected to the wireless LAN router 3 and the operation terminal 7 via a network 6. The external connector 2 is connected to the wireless LAN router 3. The device to be controlled 1 is connected to the external connector 2. In the following description, unless otherwise specified, the device to be controlled 1 may be abbreviated as "device 1", the external connector 2 as "connector 2", the wireless LAN router 3 as "router 3", and the operation terminal 7 as "terminal 7".

The device 1 is a home appliance such as an air conditioner, a refrigerator, or a television. Examples of information, which the device 1 outputs, include for example type information, operating state information, or identification information. The type information is information for specifying the type of the device 1. The operating state information is information indicating an operating state and an operating mode of the device 1. The identification information is information such as a model name and a production number for specifying the device 1. In the following description, these pieces of information are referred to as "device-to-be-controlled information 1*a*" unless otherwise specified. Note that although the connector 2 is connected to the device 1 in the device control system 100 according to the present embodiment, the device control system 100 may be configured such that a remote communication unit 24 described later has the function of the connector 2. Moreover, the type of the device 1 is not limited to the air conditioner, the refrigerator, and the television but may be any home appliance that can be operated remotely. Furthermore, not only one but a plurality of the devices 1 may be connected to the connector 2.

The terminal 7 is a terminal capable of controlling the device 1 and may be a dedicated control terminal for controlling the device 1, or may be a device used as a control terminal by implementing application software, that executes the function of controlling the device 1, on a mobile phone, a tablet terminal, or a smartphone.

The terminal 7 is configured to be able to select between two kinds of communication modes. One of the communication modes is an indoor mode that is a communication mode when the terminal 7 is located in a wireless LAN environment under which the radio waves can reach from the router 3 connected to the connector 2. The other communication mode is an outdoor mode that is a communication mode when the terminal 7 is located in an environment under which the radio waves cannot reach from the router 3 connected to the connector 2.

The terminal 7 switches the mode by automatically selecting the indoor mode when the terminal 7 is located in an area capable of the reach of the radio waves from the router 3 registered in advance in the terminal 7, namely the router 3 connected to the connector 2, or automatically selecting the outdoor mode when the terminal 7 is not located in an area capable of the reach of the radio waves from the router 3 connected to the connector 2. An example of an area capable of the reach of the radio waves from the router 3 is the inside of a home.

The terminal 7 for which the indoor mode is selected accesses the router 3 by Wireless Fidelity (Wi-Fi (registered trademark)) communication using a wireless LAN communication function, and can control the device 1 via the router 3 and the connector 2. To control the device 1 by the terminal 7 using the wireless LAN communication function, that is, to monitor and operate the device 1 is referred to as "indoor operation".

The terminal 7 for which the outdoor mode is selected uses an Internet communication function to access a communication network and an Internet public wireless communication network conforming to communication standards such as 3G, 4G, and LTE, and can control the device 1 via the server 5, the router 3, and the connector 2. Hereinafter, the communication network and the Internet public wireless communication network described above are referred to as the "network 6". To control the device 1 by the terminal 7 using the Internet communication function is referred to as "outdoor operation".

The router 3 typically has a function of determining an internet protocol (IP) address of a device connected to the router 3 by a dynamic host configuration protocol (DHCP), and thus a unique IP address is assigned to each of the connector 2 and the terminal 7 as the devices connected to the router 3. Note that although not illustrated, an optical line terminal or an asymmetric digital subscriber line (ADSL) modem for connecting the router 3 to the network 6 is installed between the router 3 and the network 6.

The handheld operation terminal 4 is, for example, an infrared remote control attached as a standard accessory to the device 1. The handheld operation terminal 4 uses near infrared light beams of 38 kHz as a carrier wave, and is suitable for use in the same room as the device 1 due to propagation characteristics of the near infrared light beams. The device control system 100 gives higher priority to an operation from the handheld operation terminal 4 located in a home than that from the terminal 7 located outside the home. Also, an operation from the handheld operation terminal 4 can be reflected preferentially even when an operation right is given to the terminal 7. Thus, even if the terminal 7 or the network 6 fails, the handheld operation terminal 4 can perform setting on the device 1. On the other hand, the terminal 7 can perform long-distance communication using the network 6 even when unable to perform wireless LAN communication with the router 3. Therefore, the terminal 7 has an advantage of being able to perform communication regardless of the presence or absence of an obstacle between the device 1 and the handheld operation terminal 4.

The server 5 includes a web server 5-1 to which the terminal 7 is connected, a database server 5-2 that stores data processed by the web server 5-1, and an operation right management unit 5-3.

Each device 1 is assigned a unique area in the database server 5-2. The terminal 7 can access only the unique area of the device 1 registered in advance.

The operation right management unit 5-3 gives an operation right to the terminal 7 which has launched an application related to an operation, thereby permitting only remote operation by the terminal 7 to which the operation right is given. The terminal 7 to which the operation right is given accesses the server 5 to acquire the device-to-be-controlled information 1*a* that is stored in the unique area in the database server 5-2. Also, when changing the setting of the device 1, the terminal 7 to which the operation right is given accesses the server 5 to change the setting in the unique area in the database server 5-2. Details regarding the operation in which the operation right management unit 5-3 manages the operation right will be described later.

Communication between the connector 2 and the router 3 may be wireless communication or wired communication. Examples of the wireless communication include IEEE 802.11 series wireless LAN communication such as Wi-Fi (registered trademark) communication, standardized Bluetooth (registered trademark) communication, and specified low power communication in a 900 MHz band. However, the wireless communication between the connector 2 and the router 3 is not limited to these communication systems, and may employ another communication system. Moreover, examples of the wired communication include communication using Ethernet (registered trademark) standardized by IEEE 802.3 and RS 485 communication, but the wired communication between the connector 2 and the router 3 is not limited to these communication systems and may employ another communication system.

The connector 2 has a function of interconverting the communication system of the device 1 and the communication system of the router 3. Specifically, the connector 2 converts the device-to-be-controlled information 1*a* transmitted from the device 1 by a unique communication system of the device 1 into communication data conforming to the Wi-Fi (registered trademark) wireless communication system, and transmits the communication data to the router 3. Moreover, the connector 2 converts setting information transmitted from the router 3 by the wireless communication system into communication data conforming to the communication system of the device 1, and transmits the communication data to the device 1. The setting information is information used to monitor and operate the device 1, and is transmitted to the device 1 via the connector 2 when the terminal 7 is operated.

Moreover, the mode of the connector 2 can be selected between the outdoor mode and the indoor mode. The mode of the connector 2 is switched by an operation on the terminal 7 or by selection of a mode selector switch provided in the connector 2.

The connector 2 for which the indoor mode is selected accesses the device 1 at regular intervals to request transmission of the device-to-be-controlled information 1*a*, and stores the device-to-be-controlled information 1*a* from the device 1. The device-to-be-controlled information 1*a* stored in the connector 2 at this time may be only the latest information or may be data for past five minutes obtained at one minute intervals. The connector 2 may transmit these pieces of data to the terminal 7. When receiving a transmission request from the terminal 7, the connector 2 transmits the device-to-be-controlled information 1*a* stored therein to the terminal 7 via the router 3. Also, the setting information from the terminal 7 is transmitted to the connector 2 via the router 3. The connector 2 transfers the received setting information to the device 1.

As described above, the connector 2 and the terminal 7, whose mode is switched to the indoor mode, communicate with each other without via the server 5. Therefore, the terminal 7 can promptly monitor and operate the device 1 independently of a communication cycle T1 (see FIG. 8) between the connector 2 and the server 5. Moreover, since the amount of information uploaded to the server 5 is reduced, an increase in the load on the server 5 can be prevented.

Note that although the device 1 can be operated by the handheld operation terminal 4, the use of the connector 2 allows the communication system of the device 1 to be converted to a general-purpose communication system such as Wi-Fi (registered trademark) or Ethernet (registered trademark). As a result, when the terminal 7 supporting Wi-Fi (registered trademark) is located in a home, the terminal 7 can monitor and operate the device 1 by performing wireless LAN communication with the router 3.

Figures 4, 5:
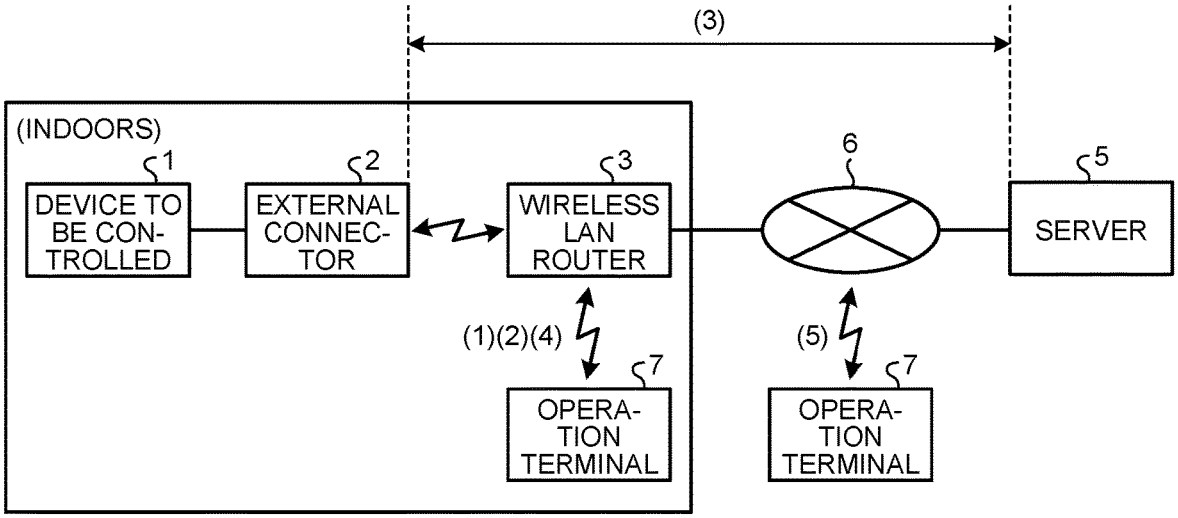
FIG. 4 is a first diagram for describing a communication mode applied to the device control system.
FIG. 5 is a second diagram for describing the communication mode applied to the device control system.

On the other hand, when the outdoor mode is selected as the communication mode, indoor communication and outdoor communication are available (see FIG. 5). The indoor communication is communication performed between the terminal 7 and the connector 2 without via the server 5 when the terminal 7 that is given the operation right and operating in the indoor mode performs an indoor operation. The outdoor communication is communication performed between the terminal 7 and the connector 2 via the server 5 when the terminal 7 that is given the operation right and operating in the outdoor mode performs an outdoor operation.

When the terminal 7 is in wireless LAN communication with the router 3, the connector 2 accepts communication from the terminal 7 via the router 3 by the indoor communication. During the indoor communication, the connector 2 accesses the device 1 at regular intervals to request transmission of the device-to-be-controlled information 1*a*, and stores the device-to-be-controlled information 1*a* transmitted from the device 1. The regular intervals include one second intervals, for example. When receiving a transmission request from the terminal 7, the connector 2 storing the device-to-be-controlled information 1*a* transmits the device-to-be-controlled information 1*a* stored therein to the terminal 7 via the router 3. Also, the setting information from the terminal 7 is transmitted to the connector 2 via the router 3. The connector 2 transfers the received setting information to the device 1. As described above, even in the case where the outdoor mode is selected, the connector 2 performs the indoor communication without via the server 5 when the terminal 7 is located in the wireless LAN environment.

When the terminal 7 does not communicate with the router 3 by wireless LAN communication, the connector 2 accesses the device 1 at regular intervals to request transmission of the device-to-be-controlled information 1*a*, and stores the device-to-be-controlled information 1*a* transmitted from the device 1. Then, the connector 2 during the outdoor communication accesses the unique area in the database server 5-2 at the communication cycle T1 to upload the device-to-be-controlled information 1*a* stored, and at the same time download the setting information stored in the unique area in the database server 5-2 and transmit the setting information to the device 1. The communication cycle T1 can be set to five minutes, for example. With the setting information being downloaded, the terminal 7 located outside the home can indirectly operate the device 1 via the server 5. In order to access the device 1 via the Internet, a dedicated communication channel, that is, a dedicated IP address needs to be secured. In general, one contract is made with an Internet provider. Therefore, in order to reduce the cost required for securing the dedicated communication channel, it is desirable to employ a communication system that monitors and operates the device 1 without changing the current Internet contract. Thus, the device control system 100 according to the present embodiment is configured such that the terminal 7 operated outdoors and the connector 2 transmit information via the server 5.

Note that the connector 2 typically connected to the device 1 for use may be driven by power supplied from the device 1 by establishing an interconnection with the device 1 using any of a power line for power supply, a ground line, and a communication line. Moreover, as for communication data, the terminal 7 needs to recognize a communication protocol of the device 1. The connector 2 may convert the protocol into a general-purpose communication protocol or into a communication protocol specific to the device 1, and when the function of the device 1 is extended, the function of the terminal 7 need only be extended accordingly. Moreover, when a user of the terminal 7 controls the operation of the device 1, an operation and a response at the time the terminal 7 is operated are required. The connector 2 is thus configured to be able to constantly accept communication from the terminal 7.

Figure 2:
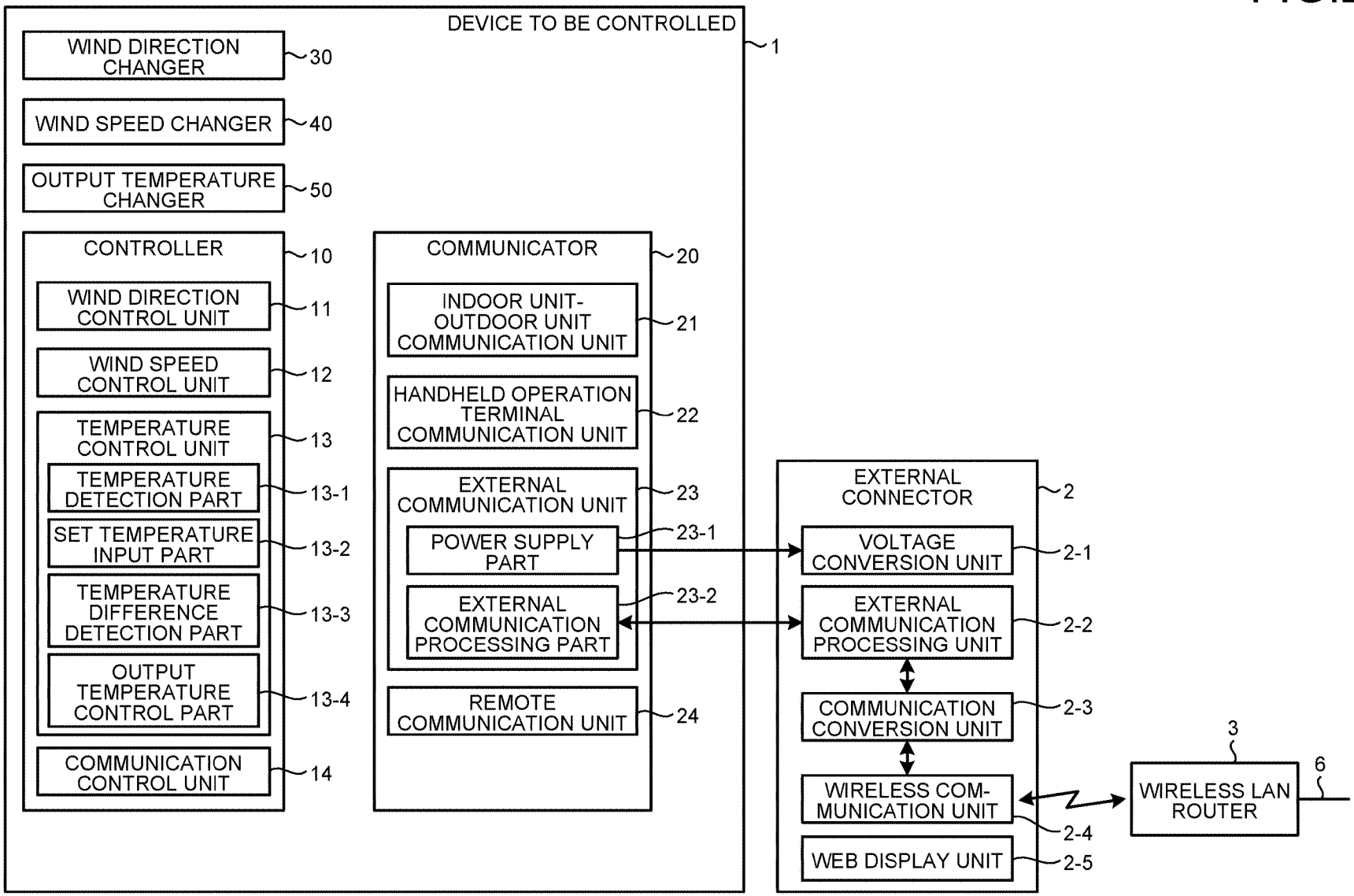
FIG. 2 is a diagram of an internal configuration of each of a device to be controlled and an external connector.

FIG. 2 is a diagram of an internal configuration of each of the device to be controlled and the external connector. The device 1 includes: a controller 10 that performs overall control on the device 1; a communicator 20 that communicates with the handheld operation terminal 4 and the connector 2; a wind direction changer 30 that operates upper and lower flaps as well as left and right vanes to change the direction of a stream of air blown out toward an indoor space, that is, change the direction of the stream of air blown out in the indoor space vertically and horizontally; a wind speed changer 40 that controls a line flow fan (registered trademark) to change the speed of the stream of air; and an output temperature changer 50 that controls operation of a refrigeration cycle of the device 1 to change the temperature of the stream of air blown out.

The controller 10 includes: a wind direction control unit 11 that operates the wind direction changer 30 to control the direction of a blown air stream that is the stream of air blown out from the device 1; a wind speed control unit 12 that operates the wind speed changer 40 to control the speed of the blown air stream; a temperature control unit 13 that operates the output temperature changer 50 to control the temperature of the blown air stream; and a communication control unit 14 that operates the communicator 20 to communicate with a device other than the device 1.

The temperature control unit 13 includes: a temperature detection part 13-1 that detects an indoor temperature by using a thermistor installed inside an indoor unit of the device 1 or a thermistor installed in the handheld operation terminal 4; a set temperature input part 13-2 that inputs a set temperature set by the handheld operation terminal 4 or the terminal 7 via the communicator 20; a temperature difference detection part 13-3 that detects a temperature difference between the indoor temperature detected by the temperature detection part 13-1 and the set temperature input to the set temperature input part 13-2 by comparing the indoor temperature and the set temperature; and an output temperature control part 13-4 that controls the temperature of the blown air stream by operating the output temperature changer 50 on the basis of the temperature difference detected by the temperature difference detection part 13-3.

The communicator 20 includes: an indoor unit-outdoor unit communication unit 21 that performs communication between the indoor unit and an outdoor unit of the device 1; a handheld operation terminal communication unit 22 that communicates with the handheld operation terminal 4; an external communication unit 23; and the remote communication unit 24.

The external communication unit 23 is an interface that allows for versatility in the communication of the device 1, and is connected to the connector 2 as a general-purpose communication adapter and is used in communicating with a device provided outside the device 1. The external communication unit 23 includes a power supply part 23-1 that supplies power to the connector 2, and an external communication processing unit 23-2 that communicates the device-to-be-controlled information 1*a* and the setting information with the connector 2. The remote communication unit 24 has both the function of the external communication unit 23 and the function of the connector 2, and is an interface for performing communication without using the connector 2. Therefore, in order for the terminal 7 to monitor and operate the device 1, the external communication unit 23 or the remote communication unit 24 need only be used. Note that, in a case where the remote communication unit 24 is not used, the connector 2 needs to be connected to the external communication unit 23.

The connector 2 includes: a voltage conversion unit 2-1 that converts a voltage supplied from the power supply part 23-1 into a voltage of a voltage level used in the connector 2; an external communication processing unit 2-2 that communicates with the external communication processing unit 23-2; a communication conversion unit 2-3 that converts data from the device 1 received by the external communication processing unit 2-2 into communication data conforming to the wireless communication system, and converts communication data from the router 3 received by a wireless communication unit 2-4 described later into communication data conforming to the communication system of the device 1; the wireless communication unit 2-4 that transmits the communication data converted by the communication conversion unit 2-3 to the router 3 by the wireless communication system and transmits the communication data from the router 3 to the communication conversion unit 2-3; and a web display unit 2-5.

The power supply part 23-1 and the voltage conversion unit 2-1 are connected by a power supply wire. The external communication processing unit 23-2 and the external communication processing unit 2-2 are connected by a communication wire. Since the power supply wire is a wire for supplying the power consumed by the connector 2, a wire having the same specification as that of the communication wire may generally be used as the power supply wire. Note that the power supply part 23-1 always need not be installed in the device 1, and an alternating current (AC) adapter may be used instead of the power supply part 23-1 to feed power from the AC adapter to the connector 2. However, the device 1 is often installed in an upper part of a room, especially on a wall of the upper part of the room so that, in a case where a power outlet is located near the floor of the room, laying of the power supply wire between the AC adapter and the connector 2 can be inconvenient. It is thus advantageous to install the function of the connector 2 on the device 1 in terms of convenience.

Figure 3:
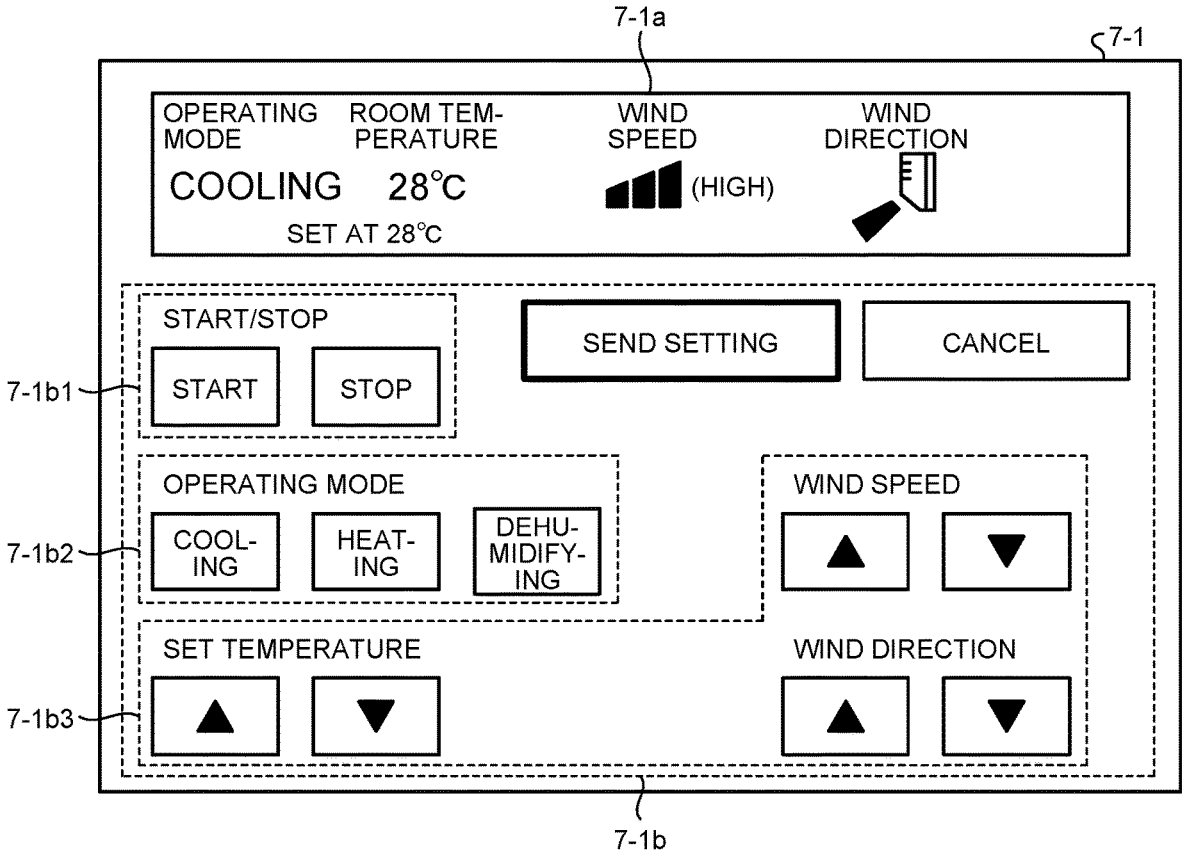
FIG. 3 is a diagram illustrating an example of an operation screen displayed on an operation terminal.

FIG. 3 is a diagram illustrating an example of an operation screen displayed on the operation terminal. FIG. 3 illustrates an example of an operation screen 7-1 displayed on a touch panel liquid crystal display by a display control function (not illustrated) of the terminal 7. The operation screen 7-1 is an example for a case where the device 1 to be operated is an air conditioner. The operation screen 7-1 includes an information display area 7-1*a* that displays setting set by a user and an operating state of the device 1, and an operation button information display area 7-1*b*. The setting includes, for example, an operating mode of the device 1 such as cooling, heating, dehumidifying, or fanning. The operating state includes, for example, the room temperature detected by the device 1, the speed of wind blown out from the device 1, and the direction of wind blown out from the device 1.

An application for displaying the operation screen 7-1 is produced in advance for each type of the device 1 and recorded on the server 5, and is recorded in the terminal 7 in a manner such that the terminal 7 accesses the server 5 and downloads the application. The operation screen 7-1 is generated by the application recorded in the terminal 7.

A plurality of operation buttons is displayed in the operation button information display area 7-1*b*. The operation buttons include, for example: start/stop operation buttons 7-1*b*1 including a start button for starting the operation of the device 1 and a stop button for stopping the device 1; operating mode buttons 7-1*b*2 for setting the operating mode; and operation buttons 7-1*b*3 for setting changes in the set temperature, the wind speed, and the wind direction. Note that, in the information display area 7-1*a* of FIG. 3, the wind direction as viewed from the side of the indoor unit is indicated by illustration as an example of indication of the wind direction of the indoor unit, but the wind direction may be indicated by text such as "up", "middle", and "down" instead of the illustration. Likewise, the wind speed may be indicated only by text such as "static", "low", "medium", and "high". Moreover, if the operation is reflected immediately after the operation button is pressed, the terminal 7 cannot deal with pressing of the operation button by mistake and switching to another operation button. Therefore, a send button for sending the setting and also for confirming the operation may be provided in the operation button information display area 7-1*b* so that the terminal 7 sends the setting when the send button is pressed. This can prevent a misoperation due to pressing of the operation button by mistake.

FIG. 4 is a first diagram for describing the communication mode applied to the device control system. FIG. is a second diagram for describing the communication mode applied to the device control system. As described above, the two types of communication modes are set to each of the connector 2 and the terminal 7. Communications described in (1) to (5) of FIG. 5 correspond to reference numerals (1) to (5) illustrated in FIG. 4.

In indoor communications (1), (2), and (4), between the connector 2 and the terminal 7 located within the reach of the radio waves from the router 3 connected to the connector 2, the device 1 is operated and monitored without via the server 5. In outdoor communications (3) and (5), between the connector 2 and the terminal 7 located beyond the reach of the radio waves from the router 3 connected to the connector 2, the device 1 is operated and monitored via the server 5.

In the indoor communications (1), (2), and (4), communication between the connector 2 and the terminal 7 occurs only when operation setting is performed by the terminal 7, and the communication is transmitted without going through the server 5. In the outdoor communications (3) and (5), on the other hand, data of the device 1 is uploaded to the server 5 in the communication cycle T1, and at the same time the setting information of the server 5 is downloaded to the connector 2. Therefore, in the indoor communications (1), (2), and (4), the communication between the connector 2 and the terminal 7 occurs only when the operation setting is performed by the terminal 7, whereas in the outdoor communications (3) and (5), the communication occurs regardless of whether or not the operation setting is performed by the terminal 7.

As described above, when the indoor mode is selected by both the connector 2 and the terminal 7, the indoor communications (1) and (4) are performed so that the device 1 can be operated and monitored without via the server 5. Moreover, when the outdoor mode is selected by both the connector 2 and the terminal 7, the device 1 can be operated and monitored regardless of whether or not the terminal 7 is located outdoors, or regardless of the communication mode of the terminal 7.

Note that in order to reduce a connection load of the server 5 in the communication cycle T1 between the connector 2 and the server 5, the device control system 100 may set the indoor mode to the connector 2 as a default setting and switch the mode to the outdoor mode using the switch of the connector 2 or the terminal 7 only when the mode needs to be switched to the outdoor mode.

Moreover, in order for the terminal 7 to switch the communication mode of the connector 2 more securely, the device control system 100 may be configured to enable switching only when the terminal 7 is in the indoor mode.

Figure 6:
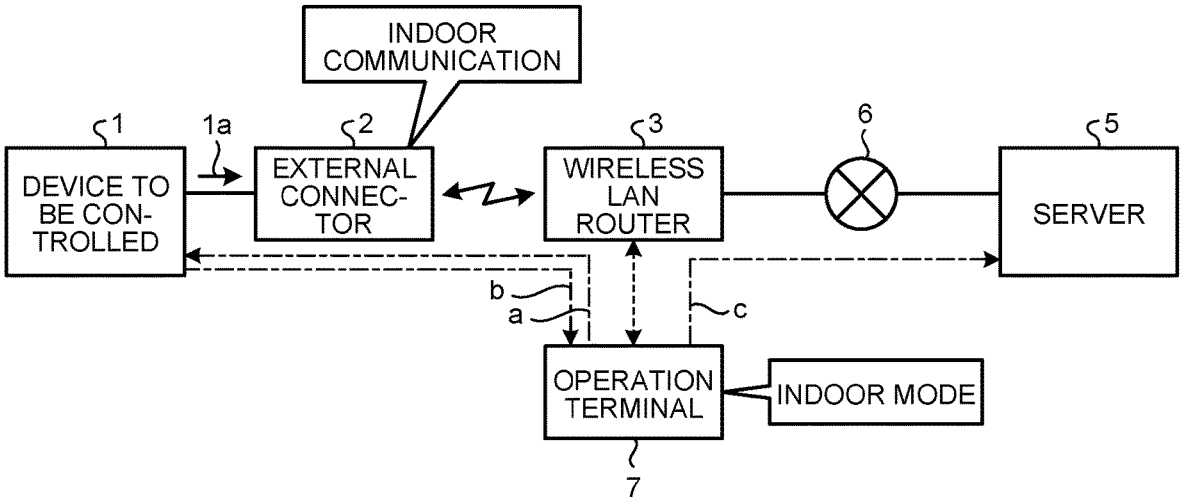
FIG. 6 is a diagram for describing an operation of the device control system when the operation terminal is located in an environment in which wireless LAN communication can be performed.

FIG. 6 is a diagram for describing an operation of the device control system when the operation terminal is located in an environment in which wireless LAN communication can be performed. The terminal 7 is switched to the indoor mode when located within the reach of the radio waves from the router 3 connected to the connector 2. At this time, the connector 2 performs the indoor communication (1) or (2) as illustrated in FIGS. 4 and 5. When the terminal 7 switched to the indoor mode performs a setting operation, the setting information is transmitted to the device 1 by going through the router 3 and then the connector 2 (a communication channel "a"). The device-to-be-controlled information 1*a* from the device 1 is transmitted to the terminal 7 by going through the connector 2 and then the router 3 (a communication channel "b"). Note that the terminal 7 and the router 3 are connected by a general-purpose encryption method used in a wireless LAN such as a Wi-Fi protected access-advanced encryption standard (WPA-AES) and a temporal key integrity protocol (TKIP), and the terminal 7 can operate the device 1 in the indoor mode when located within the reach of the radio waves from the router 3 connected to the connector 2.

The setting information of the terminal 7 is also transmitted to the server 5 by going through the router 3 and then the network 6 (a communication channel "c"), so that the operation right management unit 5-3 having received the setting information gives an operation right to the terminal 7 and registers the operation right. The operation right of the terminal 7 comes into effect from the timing when the operation right is registered, thereby allowing the terminal 7 to transmit settings to the connector 2 so that the settings of the terminal 7 are enabled. The operation right of the terminal 7 is thus managed even when the operation setting is performed in the indoor mode. As a result, the operation from the terminal 7 can be reliably reflected in the device 1 while at the same time preventing a situation where, even though the device 1 is operated, the operation setting is not reflected due to an operation by another one of the terminal 7.

Figure 7:
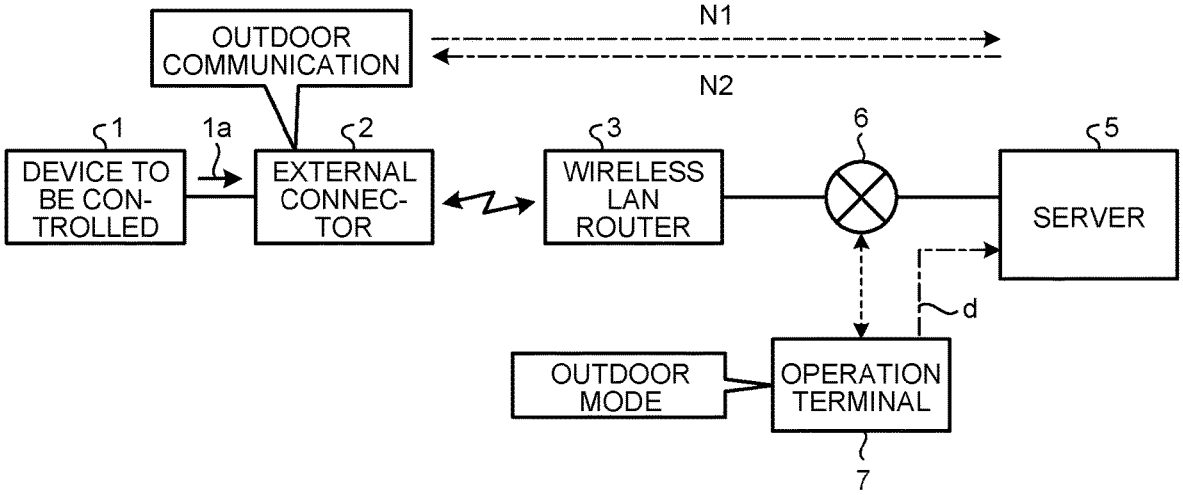
FIG. 7 is a diagram for describing an operation of the device control system when the operation terminal is located in an environment in which wireless LAN communication cannot be performed.

FIG. 7 is a diagram for describing an operation of the device control system when the operation terminal is located in an environment in which wireless LAN communication cannot be performed. The difference between FIG. 7 and FIG. 6 is that in FIG. 7, the terminal 7 is connected to the network 6 by Internet communication. Note that even in a case where the terminal 7 is located indoors, the communication as illustrated in FIG. 7 is performed when the wireless LAN communication is not enabled.

The terminal 7 is switched to the outdoor mode when located beyond the reach of the radio waves from the router 3 connected to the connector 2. The connector 2 uploads the device-to-be-controlled information 1*a* to the server 5 along with its own MAC address and serial number (a communication channel N1), and also downloads connector data in the database server 5-2 (a communication channel N2). The connector data includes setting data managed by the MAC address and the serial number, for example. The device 1 changes the setting on the basis of the setting data when the setting data has been changed.

Note that a data area to be operated in the server 5 is managed by the MAC address, and a plurality of the terminals 7 is allowed to operate and monitor the data area corresponding to the information of only the device 1 registered in advance with the MAC address information, whereby an operation from the terminal 7 that is unspecified can be prevented. Moreover, unlike an operation from a position where the device 1 can be seen, such as from the handheld operation terminal 4, the outdoor operation can result in unintended setting due to a misoperation. The operation right is managed in order to prevent such a situation, but a state of the device 1 can be checked by a terminal other than the terminal 7 to which the operation right is given. Note that the timing for giving the operation right is not limited to when the terminal 7 performs the setting operation, but may be when the terminal 7 is activated.

The setting information of the terminal 7 is transmitted to the server 5 via the network 6 (a communication channel "d"). Upon receiving the setting information, the operation right management unit 5-3 gives the operation right to the terminal 7 and registers the operation right. The operation right of the terminal 7 comes into effect from the timing when the operation right is registered.

Figure 8:
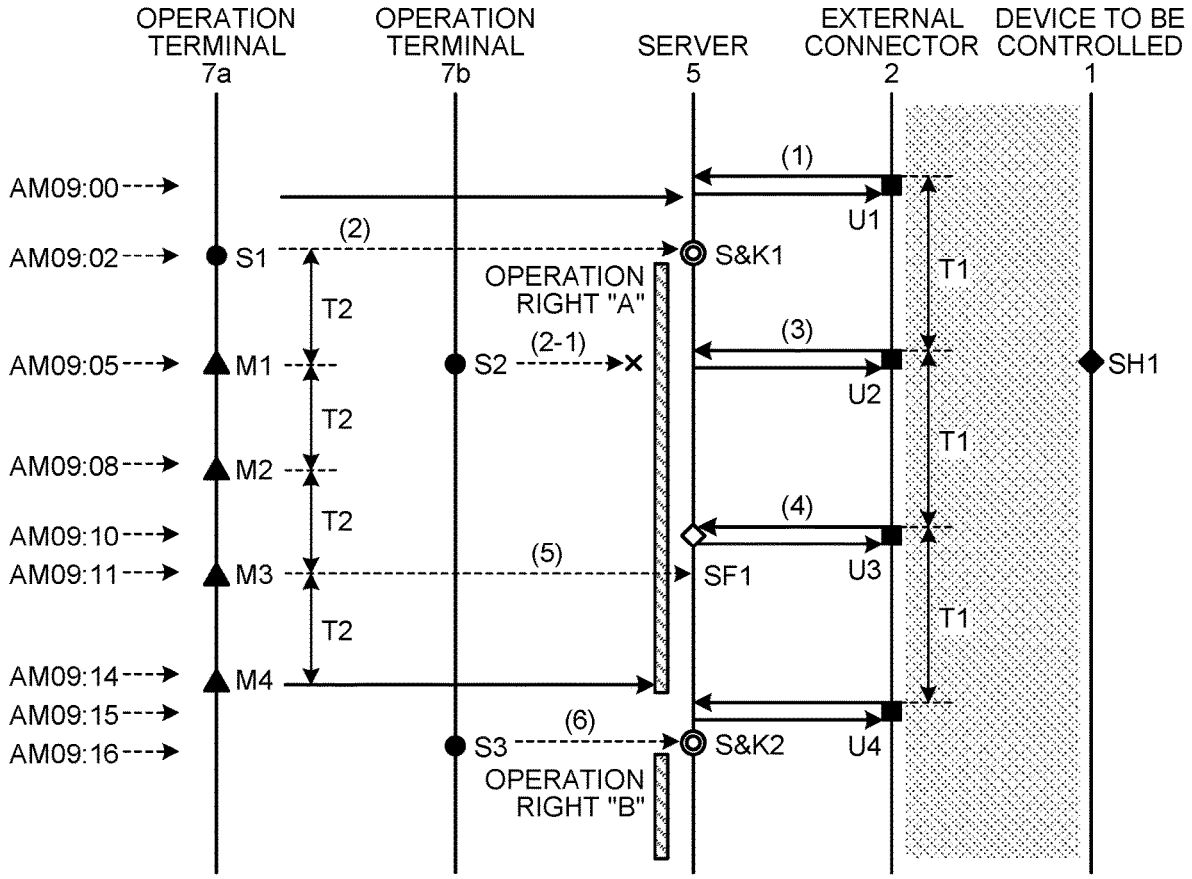
FIG. 8 is a sequence diagram illustrating an operation of the device control system.

FIG. 8 is a sequence diagram illustrating an operation of the device control system. Two terminals 7*a* and 7*b* illustrated in FIG. 8 each have a function similar to the function of the terminal 7 described above. Here, a description will be made of the operation when the terminal 7*a* performs an operation before the terminal 7*b* performs an operation while the operation right is given to neither the terminal 7*a* nor the terminal 7*b*. Communications described from (1) to (5) herein correspond to reference numerals (1) to (5) illustrated in FIG. 8.

Reference character "Un" ("n" is an integer of one or more) indicates a timing at which the connector 2 uploads the device-to-be-controlled information 1*a* to the server 5 in the communication cycle T1, and downloads the setting information stored in the server 5. Reference character "Mn" ("n" is an integer of one or more) indicates a timing at which the terminal 7*a* updates display of a state to the latest state in a screen update cycle T2. The screen update cycle T2 is a cycle in which the terminal 7*a* automatically updates the screen. The screen update cycle T2 can be set to three minutes, for example.

In a case where (1) the device-to-be-controlled information 1*a* is uploaded (U1) from the connector 2 to the server 5 at 09:00 AM, and (2) an instruction to change a setting (S1) of the device 1 is made from the terminal 7*a* to the server 5 at 09:02 AM, (3) the connector 2 transmits, to the device 1, a setting instruction downloaded at a timing of U2 at 09:05 AM. As a result, a setting (SH1) is reflected in the device 1.

(4) After the setting (SH1) is reflected in the device 1, the connector 2 uploads information of the setting (SH1) reflected in the device 1 to the server 5 at a timing of U3 at 09:10 AM. As a result, the content of the setting of the device 1 is fed back to the server 5 (SF1). (5) The terminal 7*a* can thus confirm that the setting has been reflected in the device 1 at a timing of M3 at 09:11 AM.

Note that the external communication unit 23 or the remote communication unit 24 of the device 1 illustrated in FIG. 2 transmits the setting information to the controller 10, when the external communication unit 23 or the remote communication unit 24 receives the setting information from the terminal 7. The controller 10 controls the operation of the device 1 on the basis of the setting information. Specifically, the output temperature control part 13-4, having received the setting information related to an increase or a decrease in the set temperature, controls the output temperature changer 50 so as to obtain an output temperature corresponding to the set temperature. When the room temperature at a specific time in summer is 28 degrees and the set temperature set by the terminal 7 is also 28 degrees, the indoor temperature is the same as the set temperature. In this condition, when a person who has returned home from outdoors feels hot in the room and operates a set temperature button to lower the set temperature by two degrees, the temperature detected by the temperature detection part 13-1 is 28 degrees, whereas the temperature input to the set temperature input part 13-2 is 26 degrees. The temperature difference detection part 13-3 detects that the indoor temperature is higher than the set temperature by two degrees, and thus the output temperature control part 13-4 uses the output temperature changer 50 to control the amount of refrigerant circulating between the indoor unit and the outdoor unit in order to lower the indoor temperature by two degrees. As a result, the temperature of the refrigerant is lowered, and the indoor temperature can be lowered.

Moreover, when the device 1 receives input information of the operation button for setting the wind speed, the wind speed control unit 12 controls the wind speed changer 40 such that a wind speed corresponding to a set wind speed value can be obtained. Specifically, when the wind speed is set to "high" by the terminal 7 from a state in which the wind speed is set to "low" at a specific time, the wind speed control unit 12 of the device 1 changes the wind speed by changing the wind speed of the wind speed changer 40 to a fan speed corresponding to the value of "high" registered in advance.

Moreover, when the device 1 receives input information of the operation button for setting the wind direction, the wind direction control unit 11 controls the wind direction changer 30 such that a wind direction corresponding to a set wind direction value can be obtained. Specifically, when the terminal 7 transmits a signal for changing the wind direction upward while the wind is blown downward at a specific time, the communicator 20 of the device 1 receives a setting change signal from the terminal 7 and transmits the signal to the controller 10, so that the wind direction control unit 11 of the controller 10 changes the orientation of the flap of the wind direction changer 30 upward to change the wind direction.

The device 1 can also be operated from the handheld operation terminal 4, in which case a remote control signal from the handheld operation terminal 4 is received by the handheld operation terminal communication unit 22 and transmitted to the controller 10. The subsequent processing is the same as the case where the operation signal is received from the terminal 7.

The device 1 transmits the operating state information described above to the terminal 7 via the external communication unit 23 or the remote communication unit 24. On the terminal 7 having received the operating state information, the operating mode and the wind direction of the device-to-be-controlled information 1*a* are displayed. In a case where the handheld operation terminal 4 changes the setting of the device 1 as well, the operating state information is transmitted to the terminal 7 so that the latest operating state of the device 1 can be checked.

Figure 9:
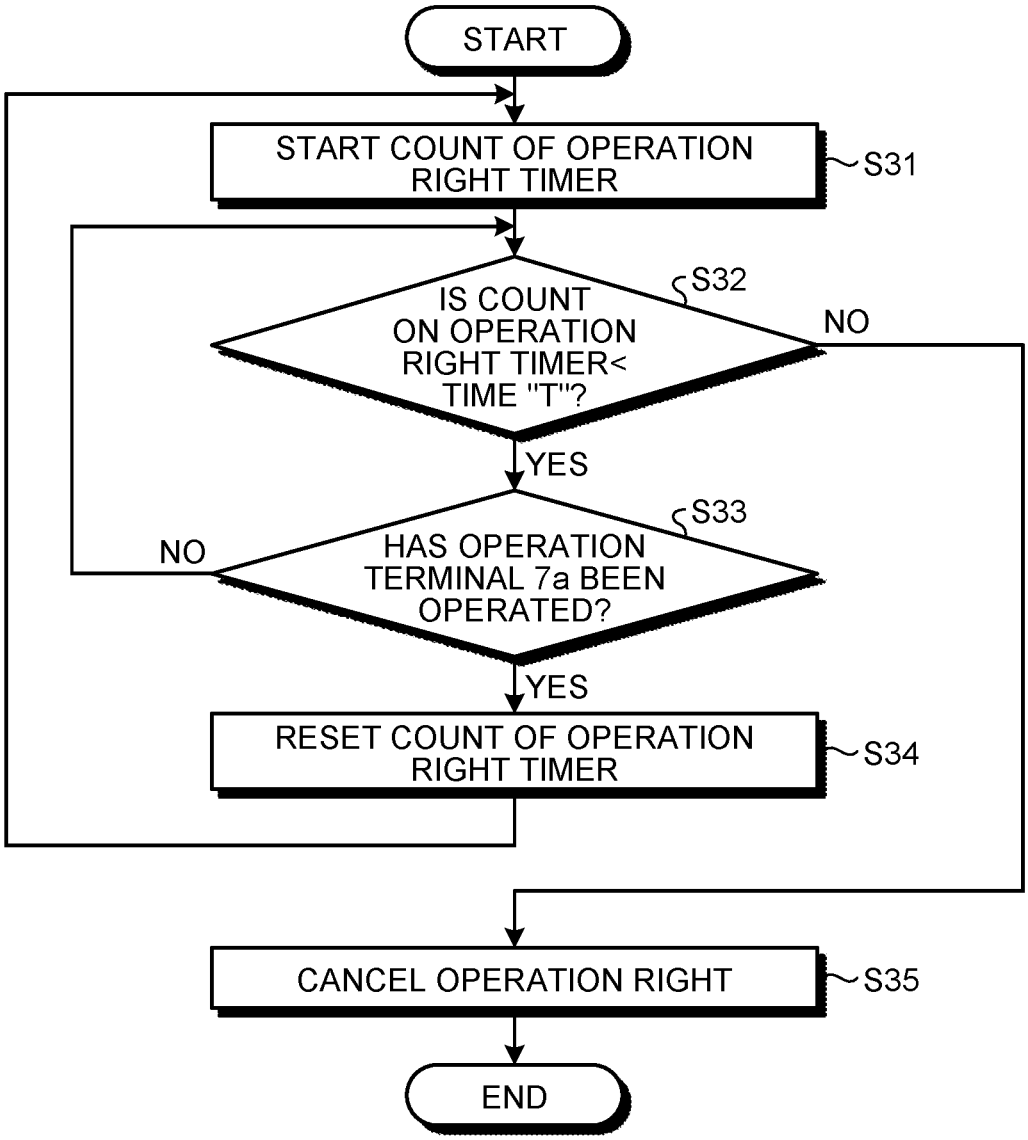
FIG. 9 is a flowchart of an operation right management operation performed by an operation right management unit illustrated in FIG. 1.

Next, the operation of managing the operation right will be described. FIG. 9 is a flowchart of the operation right management operation performed by the operation right management unit illustrated in FIG. 1. Here, the description assumes a case where the operation right is given to the terminal 7*a*.

When the operation right of the terminal 7*a* is registered, the operation right management unit 5-3 starts the count of an operation right timer at the timing of registration of the operation right (step S31). The operation right timer may be an up counter or a down counter and is assumed to be an up counter in the description here.

After the operation right timer starts counting, the operation right management unit 5-3 determines whether or not the count of the operation right timer has not reached a preset time T (step S32). If the count of the operation right timer has not reached the preset time T in step S32 (Yes in step S32), the operation right management unit 5-3 determines whether or not the terminal 7*a* has been operated on the basis of the presence or absence of a setting operation request that is the setting information from the terminal 7*a* (step S33). If determining that the terminal 7*a* has not been operated in step S33 (No in step S33), the operation right management unit 5-3 determines whether or not the count of the operation right timer has not reached the time T (step S32).

In step S33, if determining that the terminal 7*a* has been operated (Yes in step S33), the operation right management unit 5-3 resets the count of the operation right timer (step S34), and starts the count of the operation right timer again (step S31).

In step S32, if the count of the operation right timer has gone beyond the time T because the terminal 7*a* has not been operated (No in step S32), the operation right management unit 5-3 cancels the operation right of the terminal 7*a* (step S35).

When the communication cycle T1 between the connector 2 and the server 5 is five minutes, the setting operation request is transmitted to the device 1 in the first five minutes, and the state of the device 1 is transmitted to the server 5 in the next five minutes, so that, in order for the operation right to be maintained for the duration from when the setting operation request is transmitted to when the state is displayed, the duration of the operation right need only be set to a time that is three times the duration of the communication cycle T1 (i.e., 15 minutes). The duration of the operation right is thus set to the aforementioned time T, so that the operation of the device 1 by an instruction from a user of the terminal 7*a* can be maintained until the time T elapses from the time when the terminal 7*a* is operated, which can prevent frequent operation changes and a resulting misoperation.

Note that in a case where the operation right of the terminal 7*a* is canceled after the lapse of the time T, the operation right management unit 5-3 may transmit to the terminal 7*b* other than the terminal 7*a* that the operation right of the terminal 7*a* has been rescinded. Also, each terminal 7 may be configured to be able to select whether or not such transmission is necessary.

In addition, depending on the timing at which the terminal 7*a* performs the setting operation on the device 1, the communication system, and the communication channel, the setting operation may be reflected in a shorter time than the communication cycle T1. In this case, the period for maintaining the operation right may be set shorter than the time T. The time T is, for example, the time that is three times the duration of the communication cycle T1 (i.e., 15 minutes) as described above.

Moreover, the operation right does not necessarily need to be maintained for the time T. The terminal 7*b* waiting for the operation right to be given may be registered in the operation right management unit 5-3, and the operation right management unit 5-3 may give the operation right to the terminal 7*b* at a timing when the terminal 7*a* having the operation right logs out or shuts down.

Next, the operation of managing the operation right will be specifically described by using the sequence of FIG. 8. Communications described from (1) to (6) and (2-1) herein correspond to reference numerals (1) to (6) and (2-1) illustrated in FIG. 8.

(1) The device-to-be-controlled information 1*a* is uploaded (U1) from the connector 2 to the server 5 at 09:00 AM. (2) In a case where the operation right is given to neither the terminal 7*a* nor the terminal 7*b* at a timing when an instruction to change the setting (S1) of the device 1 is made from the terminal 7*a* to the server 5 at 09:02 AM, the server 5 accepts the setting S1 from the terminal 7*a* and at the same time registers that the operation right is given to the terminal 7*a* (S&K1). An operation right "A" of the terminal 7*a* comes into effect from the timing of S&K1.

(2-1) When the terminal 7*b* performs a setting operation of the same device 1 at 09:05 AM after the operation right "A" is given to the terminal 7*a*, a setting change instruction (S2) is transmitted to the server 5, but the server 5 recognizes the operation right "A" and thus responds to the terminal 7*b* with the fact that the terminal 7*b* does not have the operation right. (3) The connector 2 transmits, to the device 1, the setting instruction downloaded at the timing of U2 at 09:05 AM. As a result, the setting (SH1) is reflected in the device 1. (4) After the setting (SH1) is reflected in the device 1, the connector 2 uploads the information of the setting (SH1) reflected in the device 1 to the server 5 at the timing of U3 at 09:10 AM. As a result, the content of the setting of the device 1 is fed back to the server 5 (SF1). (5) The terminal 7*a* can thus confirm that the setting has been reflected in the device 1 at the timing of M3 at 09:11 AM.

Since a user of the terminal 7*a* can confirm at the timing of M3 that the content set by the terminal 7*a* has been reflected in the device 1, the server 5 may cancel the operation right "A", but the user of the terminal 7*a* may not notice that the content of the setting has been reflected in the device 1 at the timing of M3. Also, even if the user notices that the setting has been reflected, the setting may be changed to another setting by a user of the terminal 7*b*. In order to prevent such a situation, the server 5 may maintain the operation right "A" until a predetermined period of time elapses after the timing of M3 at which the content of the setting is successfully fed back, and in the example of FIG. 8, the operation right "A" is maintained from the timing of M3 up to a next state update timing.

(6) After that, when a setting change is instructed (S3) from the terminal 7*b* at the timing of 09:16 AM at which the operation right "A" is no longer in effect, the operation right management unit 5-3 accepts the instruction (S3) from the terminal 7*b* and at the same time registers an operation right "B" of the terminal 7*b* (S&K2). As a result, the operation right "B" of the terminal 7*b* comes into effect.

Note that the communication cycle T1 is set to five minutes in the present embodiment but is not limited to five minutes. The shorter the communication cycle, the faster the operation is reflected, which however causes an increase in the communication load in a case where a large number of the devices 1 are connected to the server 5. Therefore, the communication cycle T1 is desirably set to an optimum value in consideration of the number of the devices 1 connected to the server 5. Moreover, the device 1 and the connector 2 perform communication in which the device 1 responds to a request of the connector 2 at one second intervals, for example.

Next, functions and operations for solving the aforementioned problem in the device control system 100 will be described.

Figure 10:
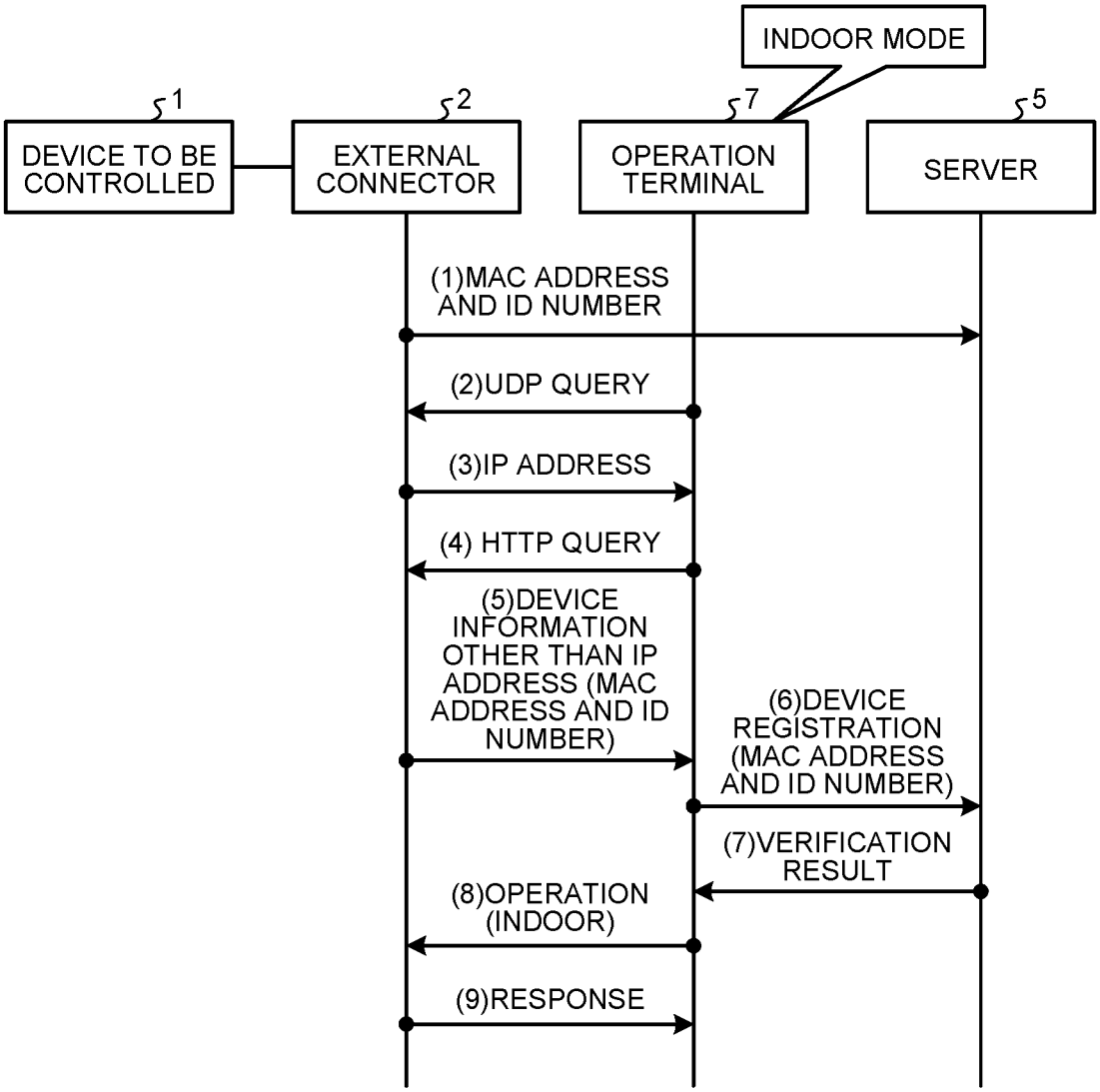
FIG. 10 is a sequence diagram for registering, in the operation terminal, information of the external connector connected to a router in the device control system according to the embodiment.

FIG. 10 is a sequence diagram for registering information of the external connector connected to the router in the operation terminal in the device control system according to the embodiment. The device 1, the connector 2, the terminal 7, and the server 5 illustrated in FIG. 10 are included in the device control system 100. Communications described from (1) to (9) herein correspond to reference numerals (1) to (9) illustrated in FIG. 10.

(1) The connector 2 stores the device-to-be-controlled information 1*a* of the device 1, and also has uniform resource locator (URL) information for accessing the dedicated database server 5-2 that has data for operation setting. The connector 2 transmits device information of the connector 2 to the URL. The server 5 has a data area corresponding to an MAC address and records, in the data area, the received device information and setting information. The device information of the connector 2 includes the MAC address and an identification (ID) number, for example.

(2) After the connector 2 transmits the device information of the connector 2 to the server 5, the terminal 7 in the indoor mode typically completes boot-up processing and then broadcasts a specific response request by user datagram protocol (UDP) communication to the device 1 and the connector 2 that are devices connected to a local network in the same home. The response request is a UDP query that is a query asking "Is the device a device "A"?". Not all the devices connected to the local network in the same home have to respond to the query, and only a specific device such as the device 1 or the connector 2 may respond. Moreover, the query need not ask whether or not the device is the device "A", and may ask for any of a model name of the device, a manufacturer's name, and a series of numbers. Such a configuration in which only the specific device makes the UDP response eliminates the load of processing a response from an unwanted device.

(3) The UDP response to the UDP query is made. For example, the connector 2 makes the UDP response. Since an IP address of the device is assigned to the UDP response to the UDP query, the terminal 7 can acquire only the IP address of a specific device.

(4) Since the UDP response may be made by a plurality of devices, the terminal 7 performs an HTTP query that asks, by HTTP communication, the IP addresses of the devices which have responded for the device information other than the IP address. The device information other than the IP address includes, for example, the MAC address, the ID number, the model name of the device 1, and a software version. Note that the connector 2 is provided in advance with a device information response function so as to respond to the HTTP query from the terminal 7 with the device information. As a result, the terminal 7 in the indoor mode can acquire the IP address to be connected and the device information other than the IP address. The device information other than the IP address includes the MAC address and the ID number, for example.

(5) The connector 2 transmits the device information other than the IP address to the terminal 7. The terminal 7 receives the device information of the device transmitted from the connector 2 and registers the device information in the terminal 7. The registration of the device information in the terminal 7 is hereinafter referred to as "device registration". Note that the terminal 7 may be configured to register the acquired MAC address in the terminal 7 by automatic input. Registering the MAC address by automatic input has an advantage that a user need not check the MAC address of the device.

(6) The terminal 7 transfers the acquired MAC address and ID number to the server 5. (7) The server 5 having received the MAC address and the ID number from the terminal 7 verifies the MAC address with the MAC address of each device registered in advance in the server 5, thereby determining whether or not the devices registered in the terminal 7 match the devices registered in the server 5 and transmitting a result of the verification to the terminal 7. (8) On the basis of the result of the verification from the server 5 and the IP address transmitted from the connector 2, the terminal 7 performs communication for operating the device 1 and the connector 2 each being an example of the device. The terminal 7 performs, for example, an indoor operation. As a result, the device 1 and the connector 2 each being an example of the device registered in the terminal 7 can be monitored and operated from the terminal 7. (9) As a response to the operation by the terminal 7, the connector 2 transmits, for example, operating state information of the device 1 to the terminal 7.

Note that the verification of the device by the server 5 may include a mechanism for verifying whether or not a device to be connected to the terminal 7 is located in the same home as the terminal 7. Since the MAC address contains a number specific to the manufacturer in high-order bits and a unique number in low-order bits, if the terminal 7 located outdoors is allowed to perform an operation using only the information of the MAC address, in a case where the low-order bits are set to a consecutive number and a user inputs a wrong MAC address instead of the correct MAC address of the device to be operated by the terminal 7, there is a possibility that the device 1 installed in another home is operated. In order to prevent such a situation, the server 5 may be configured to use the production number, the serial number, and the ID number written on the body of each of the device 1 and the connector 2 as authentication keys to verify whether or not the MAC address has an authorized value.

A specific example of this mechanism is that, when the connector 2 operates at the timing of (1) in FIG. 10, the connector 2 transmits its own MAC address and ID number to the server 5 so that the server 5 recognizes the ID number associated with the MAC address. Then, the user of the terminal 7 registers, on a device registration screen of the terminal 7 in the indoor mode, the MAC address and the ID number indicated on the body of each of the device 1 and the connector 2. The information registered in the terminal 7 is transmitted to the server 5. The server 5 having received the information registered in the terminal 7 verifies the MAC address and the ID number of the device registered in advance with the MAC address and the ID number registered in the terminal 7, thereby determining whether or not the device registered in the terminal 7 matches the device registered in the server 5. In a case where the device registered in the terminal 7 matches the device registered in the server 5, the specific device registered in the terminal 7 can be monitored and operated from the terminal 7.

In addition, since the IP address assigned to the connector 2 by the router 3 changes in some cases, the terminal 7 may perform processing of confirming the IP address and processing of verifying the device upon launching the application. Also, when the terminal 7 having been unused for a long time is used again, the terminal 7 may perform the processing of confirming the IP address and the processing of verifying the device again.

Figure 11:
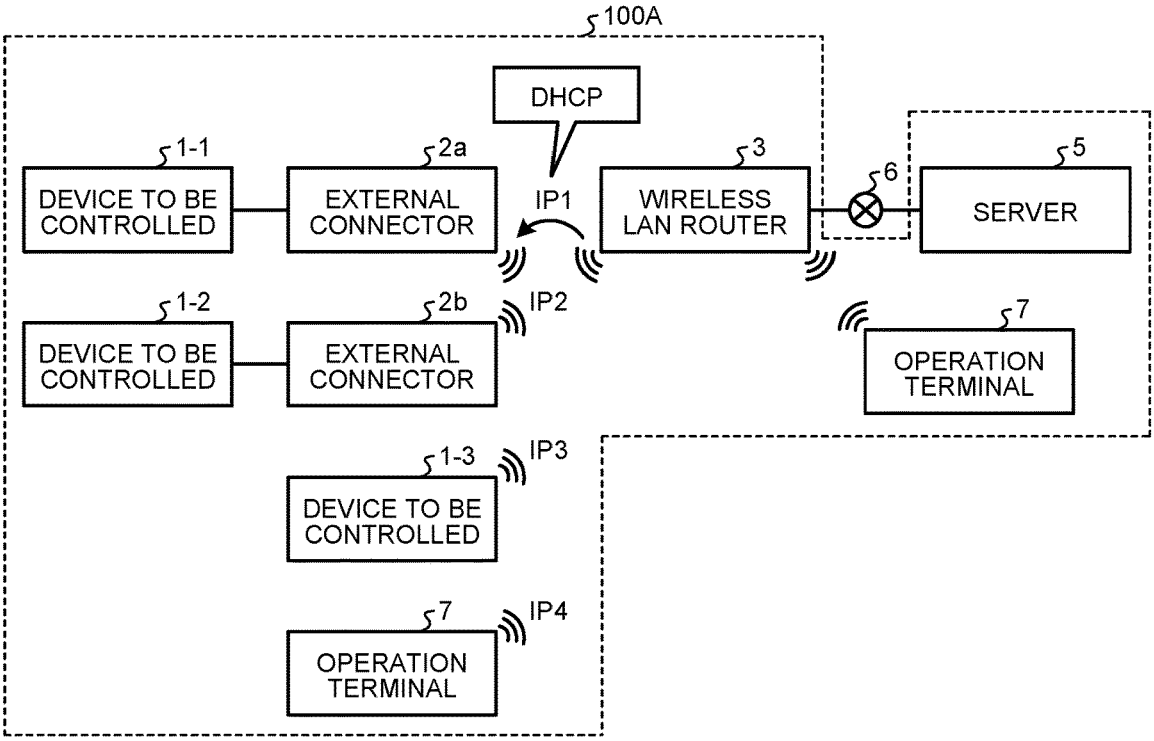
FIG. 11 is a first diagram for describing a problem in a device control system according to a comparison reference example.
Figure 12:
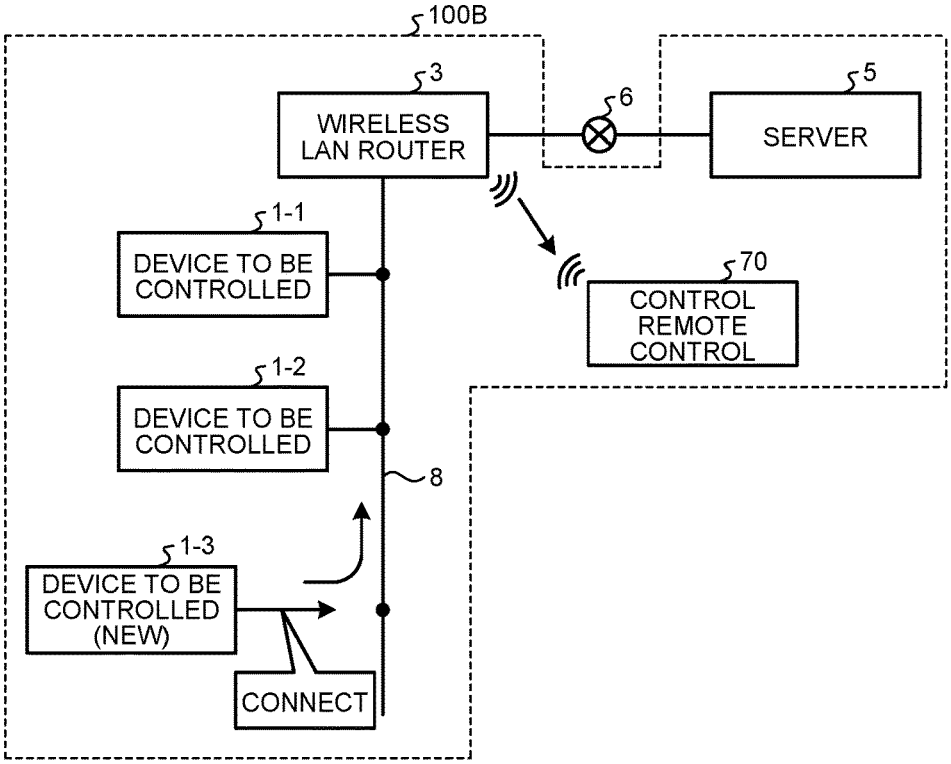
FIG. 12 is a second diagram for describing a problem in a device control system according to a comparison reference example.

FIG. 11 is a first diagram for describing a problem in the device control system according to a comparison reference example. FIG. 12 is a second diagram for describing a problem in the device control system according to a comparison reference example.

A device control system 100A illustrated in FIG. 11 is a system that uses a wireless LAN and operates a plurality of devices 1-1, 1-2, and 1-3 installed in a home via the network 6. The router 3 connected to the network 6 has a DHCP function of automatically assigning a unique IP address to each of a plurality of devices connected to the router 3, and the plurality of devices include a connector 2*a*, a connector 2*b*, the device 1-3, and the terminal 7. Here, since the router 3 has assigned the IP address to each device, the router 3 has the IP address of each device, whereas the terminal 7 does not have the IP addresses of the connectors 2*a* and 2*b* and thus cannot access the connectors 2*a* and 2*b* via the router 3 even when wanting to operate the devices 1-1 and 1-2.

In order to solve such a problem, a device control system 100B illustrated in FIG. 12 is configured as follows. The router 3 having the DHCP function is connected between a LAN 8 and the network 6. The plurality of devices 1-1 and 1-2 and a control remote control 70 are connected to the router 3. The control remote control 70 can monitor states of the devices 1-1 and 1-2 and perform operation setting on the devices 1-1 and 1-2 via the router 3. In a case where the device 1-3 is newly connected to the device control system 100B, the device 1-3 transmits device information of the device 1-3 necessary for connection to the network 6 to all the devices connected to the LAN 8, that is, the device 1-1, the device 1-2, and the router 3. The device information of the device 1-3 is also transmitted to the control remote control 70 via the router 3 and registered in the control remote control 70. Thus, if the device information of the device 1-3 includes the IP address of the device 1-3, the control remote control 70 can know the IP address of the device 1-3 and operate the device 1-3.

However, the device control system 100B employs the DHCP function that may cause the irregularly assigned IP address to change, and as a result in that the control remote control 70 may not be able to access the device 1-3 via the network 6. Moreover, the device information of the device 1-3 newly connected to the LAN 8 is transmitted to all the devices connected to the LAN 8, so that there is a problem that the device control system 100B has concerns in terms of security.

Figures 13, 14:
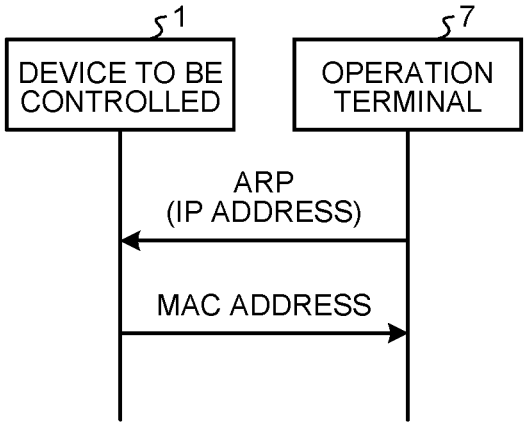
FIG. 13 is a diagram illustrating an open systems interconnection (OSI) reference model.
FIG. 14 is a diagram for describing a flow of acquiring a media access control (MAC) address by using an address resolution protocol (ARP).

Meanwhile, there is a method of knowing the IP address by a method different from that of the device control system 100B. FIG. 13 is a diagram illustrating an OSI reference model, and FIG. 14 is a diagram for describing a flow of acquiring the MAC address by using an ARP.

In the OSI reference model of FIG. 13, a data link layer that is a second layer uses the MAC address as a fixed address assigned to each device, a network layer that is a third layer uses the IP address, and a transport layer that is a fourth layer uses a UDP that bridges the IP address in the network layer and a protocol in a session layer or above (such as a protocol in an application layer that is a seventh layer). When the application of the terminal 7 uses the UDP and instructs devices connected to a local network in a single home to return IP addresses, the terminal 7 can acquire the IP address as a response but does not know which device has the IP address acquired. Acquisition of the MAC address in the second layer is desired for identifying the device 1, but the MAC address cannot be checked from the application layer via the UDP.

Therefore, the ARP of FIG. 14 can be used as a technique for running a query to obtain the MAC address based on the IP address. The ARP is a protocol for obtaining the MAC address based on a destination IP address and is used such that, when the MAC address of a destination is unknown, a transmission source broadcasts a query for the MAC address of the IP address, and a device not having the IP address designated does not respond to the query, whereas a device having the corresponding IP address returns the MAC address. The ARP is used to be able to acquire information on the MAC address unique to the device for an unspecified IP address, so that the IP address of the device can be known by verifying the acquired MAC address with the MAC address written on the body of the device. In the example illustrated in FIG. 14, the operation terminal 7 broadcasts an ARP request that asks for the MAC address of the IP address. In response to the ARP request, the device to be controlled 1 that is the device having the designated IP address returns the MAC address.

However, the method using the ARP requests all the devices connected to the local network to respond with the IP addresses, so that the operation terminal 7 needs to run a query to see which device the MAC address corresponds to for the many IP addresses of the devices responded, which takes time for the verification and is also not secure because any operation terminal 7 can make a request and respond.

The device control system 100 according to the present embodiment is a system that includes the server 5 connected to the network 6 and controls at least one of the connector 2 or the device 1 in a home from the terminal 7 via the network 6. When located in a home LAN environment, the terminal 7 operates in the indoor mode that is a first communication mode for communicating with the connector 2 without going through the server 5, and, when not located in the home LAN environment, the terminal 7 operates in the outdoor mode that is a second communication mode for communicating with the device 1 via the server 5. The terminal 7 set to the first communication mode is configured to request at least one of the connector 2 or the device 1 connected to the local network in the same home as the terminal 7 to respond with information including the IP address of the device 1. This configuration allows the terminal 7 to acquire only the IP address of a specific device even when the IP address assigned by the DHCP function of the router 3 is changed.

Also, even when the device 1-3 is newly connected to the LAN 8 as in the device control system 100B illustrated in FIG. 12, the IP address of the device is not transmitted to all devices so that the security problem can be solved. Moreover, unlike the method using the ARP as illustrated in FIG. 14, the time and effort to run a query to see which device the MAC address corresponds to for the many IP addresses of the devices responded are unnecessary.

Note that the terminal 7 may be configured to display the device already registered in the terminal 7 on a screen of the terminal 7. Specifically, the terminal 7 having received the device information including the MAC address as a response to an HTTP query verifies the device information newly input to the terminal 7 with the device information already registered in the terminal 7. When finding the device already registered as a result of the verification, the terminal 7 displays the information of the registered device on the screen of the terminal 7 as "the device 1-1 is already registered". When finding an unregistered device, the terminal 7 displays on the screen thereof the location of the unregistered device 1 and the name of the unregistered device 1 as well as an input field for the MAC address and an input field for the ID number in association with the name of the unregistered device 1.

FIG. 15 is a diagram for describing communication modes featured in the present embodiment. FIG. 15 illustrates a communication channel N1, a communication channel N2, a communication channel "d", and a communication channel "e" that are added in addition to what is illustrated in FIG. 6. In the communication channel "e", the connector 2 and the terminal 7 directly communicate with each other. Two cases will be described below as examples in which the connector 2 and the terminal 7 directly communicate with each other.

In the first case, the connector 2 is connected to the router 3 in order to establish the communication channels "a", "b", and "c" or to establish the communication channel "d", and the terminal 7 and the connector 2 are temporarily connected to each other in order for the terminal 7 to rewrite the setting information of the wireless communication unit 2-4 in the connector 2.

In the second case, without going through the router 3 and the server 5, the terminal 7 reads information related to the external communication processing unit 2-2 recorded in the wireless communication unit 2-4 of the connector 2 or writes setting in the wireless communication unit 2-4 of the connector 2, whereby the terminal 7 and the connector 2 are directly connected to each other in order to monitor and operate the device 1.

Next, details of the above two cases will be described. Note that in the following description, a first connection mode in which the connector 2 is connected to the router 3 through the communication channel "a" and the communication channel "b" will be referred to as "router connection mode", and a second connection mode in which the connector 2 is connected to the terminal 7 through the communication channel "e" will be referred to as "terminal connection mode". In the first connection mode, the connector 2 and the terminal 7 are connected to each other via the router 3. In the second connection mode, the connector 2 and the terminal 7 are connected to each other without via the router 3.

FIG. 16 is a table illustrating a method of switching the connection mode of each of the external connector and the operation terminal to the router connection mode or the terminal connection mode, and a connection state of each of the external connector and the operation terminal.

The external connector 2 and the operation terminal 7 set to the router connection mode are connected to the router 3 through the communication channels "a" and "b" illustrated in FIG. 15. The external connector 2 set to the terminal connection mode is directly connected to the operation terminal 7 through the communication channel "e" illustrated in FIG. 15. The operation terminal 7 set to the terminal connection mode is directly connected to the external connector 2 through the communication channel "e" illustrated in FIG. 15.

A method of switching the mode of the external connector 2 includes, for example, a method of switching a switch provided in the external connector 2. The switch provided in the external connector 2 corresponds to a switch which will be described later. A method of switching the mode of the operation terminal 7 includes, for example, a method of manually changing the mode on the operation terminal 7 or a method of automatically establishing a connection on the basis of a connection history. In the method of automatically establishing a connection on the basis of a connection history, the operation terminal 7 is automatically connected to the external connector 2 or the router 3 when detecting the external connector 2 or the router 3 to which the operation terminal 7 has been connected before. Note that the operation terminal 7 may be configured to display thereon a list of the routers 3 to which the operation terminal 7 has been connected before, and allow a user of the operation terminal 7 to select any of the routers 3.

Figure 17:
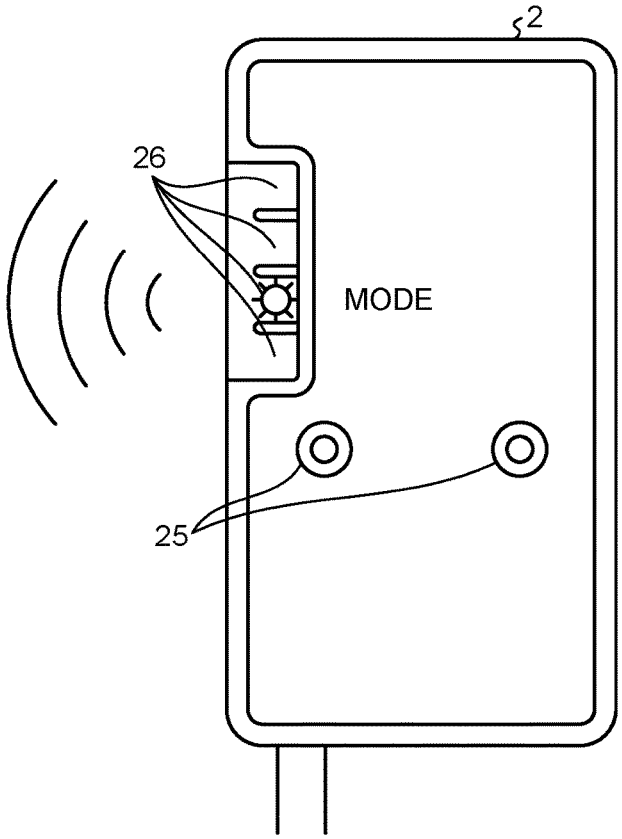
FIG. 17 is a diagram illustrating a product image of the external connector.

FIG. 17 is a diagram illustrating a product image of the external connector. The external connector 2 includes two of the switches 25 and LEDs 26 which are four diodes.

The external connector 2 is configured to switch the connection mode depending on the time length for which one of the two switches 25 is pressed. The switch 25 is referred to as "mode selector switch".

The external connector 2 does not have a display unit, and is thus provided with the LEDs 26 to be able to indicate which state a status of the connection mode is. In FIG. 17, one of the four LEDs 26 indicates the status of the mode. The LED 26 indicating the status of the mode is referred to as "mode status LED".

Figure 18:
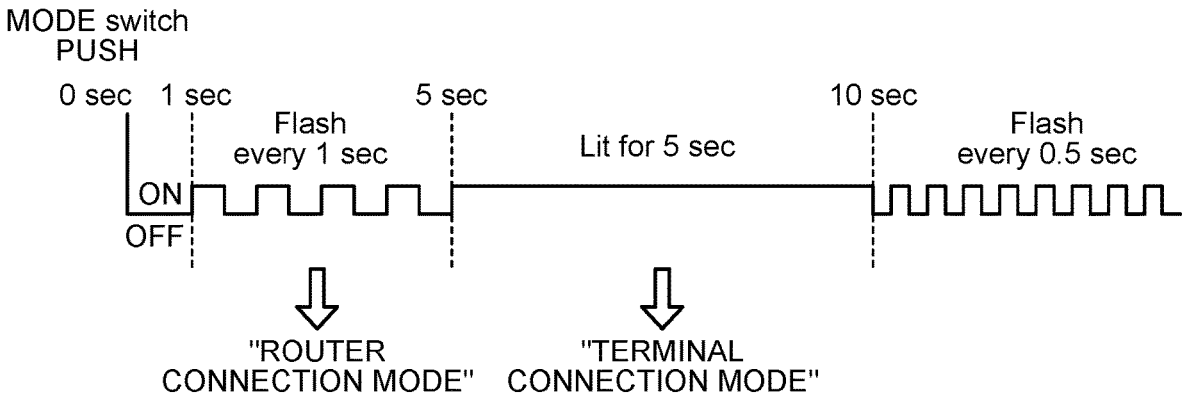
FIG. 18 is a diagram for describing an operation when the connection mode is switched using a mode selector switch of FIG. 17.

FIG. 18 is a diagram for describing an operation when the connection mode is switched using the mode selector switch of FIG. 17. The external connector 2 switches the connection mode to the router connection mode or the terminal connection mode depending on the time length for which the mode selector switch is pressed.

In FIG. 18, "MODE switch PUSH" indicates that the mode selector switch is pressed. A timing when the mode selector switch is pressed is indicated by "0 sec". Each of "1 sec", "5 sec", and "10 sec" indicates an elapsed time from the timing when the mode selector switch is pressed. A state in which the mode status LED is turned off is indicated by "OFF" from "0 sec" to "1 sec". A state in which the mode status LED flashes at one second intervals is indicated by "Flash every 1 sec" from "1 sec" to "5 sec". A state in which the mode status LED is lit for five seconds is indicated by "Lit for 5 sec" from "5 sec" to "10 sec". A state in which the mode status LED flashes at 0.5 second intervals is indicated by "Flash every 0.5 sec" after "10 sec".

The external connector 2 causes the mode status LED to flash at one second intervals after a lapse of one second or longer and up to a lapse of five seconds from the timing when the mode selector switch is pressed. When the mode selector switch is released during this time period, the external connector 2 shifts to the router connection mode.

The external connector 2 causes the mode status LED to be lit after a lapse of five seconds or longer and up to a lapse of ten seconds from the timing when the mode selector switch is pressed. When the mode selector switch is released during this time period, the external connector 2 switches the connection mode from the router connection mode to the terminal connection mode.

The external connector 2 causes the mode status LED to flash at 0.5 second intervals after a lapse of ten seconds or longer from the timing when the mode selector switch is pressed. At this time, the external connector 2 may switch the connection mode to another connection mode on the basis of the time length for which the mode selector switch is pressed.

Note that the external connector 2 is configured such that the connection mode and the LED lighting pattern are not switched until a certain period of time elapses from the timing when the mode selector switch is pressed. The certain period of time is, for example, one second. This is to prevent false setting when the mode selector switch is pressed by mistake. Note that the external connector 2 having such a mode switching function may be installed in the device to be controlled 1.

Next, FIGS. 19 to 23 will be used to describe the operation performed in the aforementioned first case in which the external connector 2 and the operation terminal 7 are temporarily connected to each other, and the operation terminal 7 rewrites the setting information of the wireless communication unit 2-4 in the external connector 2.

Figure 19:
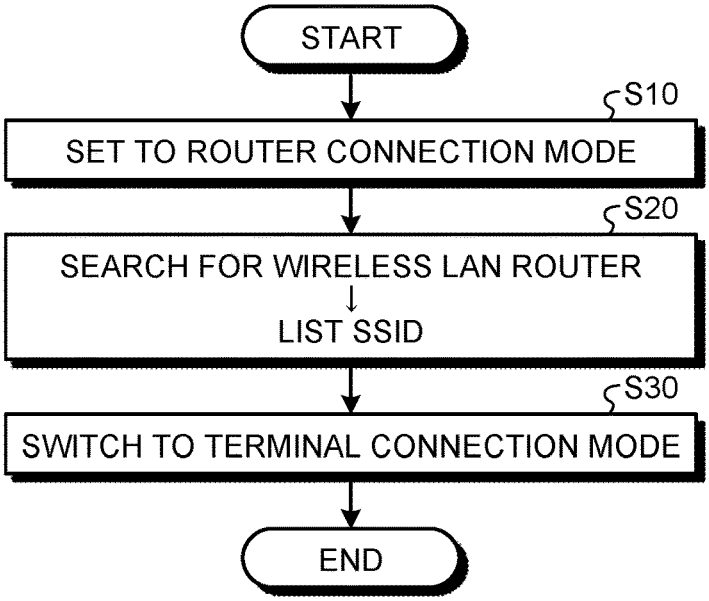
FIG. 19 is a flowchart of an operation in which the operation terminal rewrites setting information of a wireless communication unit in the external connector.

FIG. 19 is a flowchart of the operation in which the operation terminal rewrites the setting information of the wireless communication unit in the external connector. In the example of FIG. 19, the external connector 2 is first set to the router connection mode before being switched to the terminal connection mode (step S10).

In order to establish the communication channel "e" in the router connection mode, the mode selector switch of the external connector 2 is pressed. When the mode selector switch is released after a lapse of five seconds or longer and less than ten seconds from the timing when the mode selector switch is pressed, the wireless communication unit 2-4 of the external connector 2 searches for one or a plurality of the routers 3 located around the external connector 2 as illustrated in FIG. 19. That is, the wireless communication unit 2-4 of the external connector 2 detects an SSID of the router 3 located around the external connector 2. The wireless communication unit 2-4 of the external connector 2 lists network information, namely the SSID, of the one or plurality of the routers 3 extracted as a result of the search (step S20).

After the SSID is listed, the external connector 2 switches the mode to the terminal connection mode (step S30). Note that the wireless communication unit 2-4 of the external connector 2 may periodically search for the information on the router(s) 3 around and store the information on the router(s) 3 obtained by the search in an internal memory of the external connector 2. Then, the operation terminal 7 selects the external connector 2 as a target to connect to wirelessly.

Figure 20:
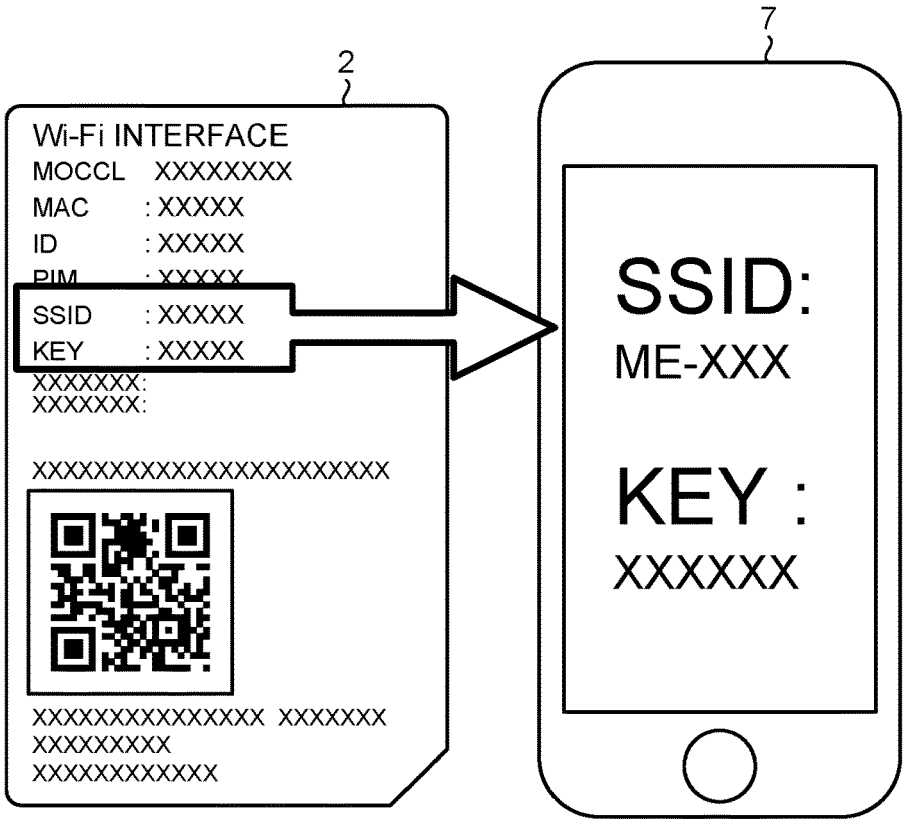
FIG. 20 is a diagram for describing an example of a method of selecting the external connector.

FIG. 20 is a diagram for describing an example of a method of selecting the external connector. As illustrated in FIG. 20, SSID and KEY that are connection information of the external connector 2 are indicated on the body of the external connector 2. Note that the connection information of the external connector 2 may be indicated in an instruction manual or on a packaging box of the external connector 2.

When selecting the external connector 2, the SSID and KEY illustrated in FIG. 20 are input to the operation terminal 7 to wirelessly connect the operation terminal 7 to the wireless communication unit 2-4 of the external connector 2. At this time, the operation terminal 7 can check whether the external connector 2 is wirelessly connected to the operation terminal 7. Note that the lighting pattern of the LED 26 on the external connector 2 illustrated in FIG. 17 after the wireless connection is established may be changed from the lighting pattern before the wireless connection is established, so that a user can determine whether or not the wireless connection has been established by looking at the external connector 2.

Figure 21:
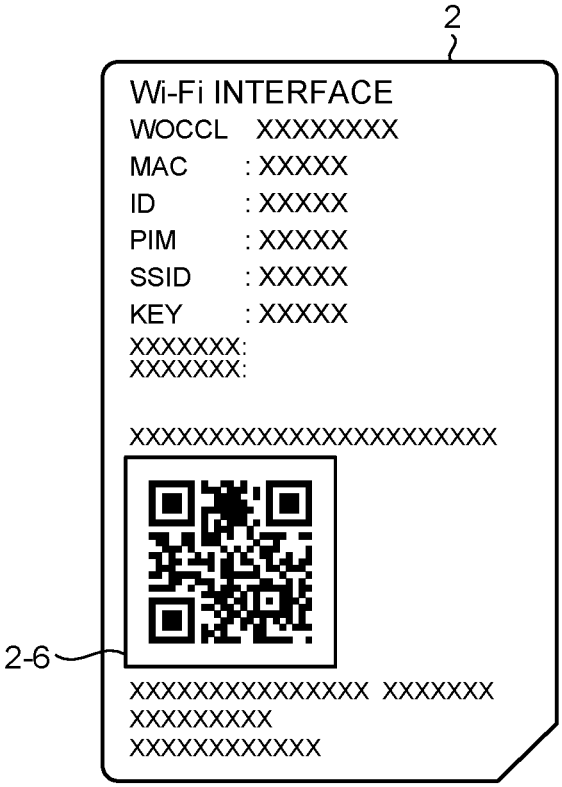
FIG. 21 is a diagram illustrating an example of a two-dimensional code assigned to the external connector.
Figure 22:
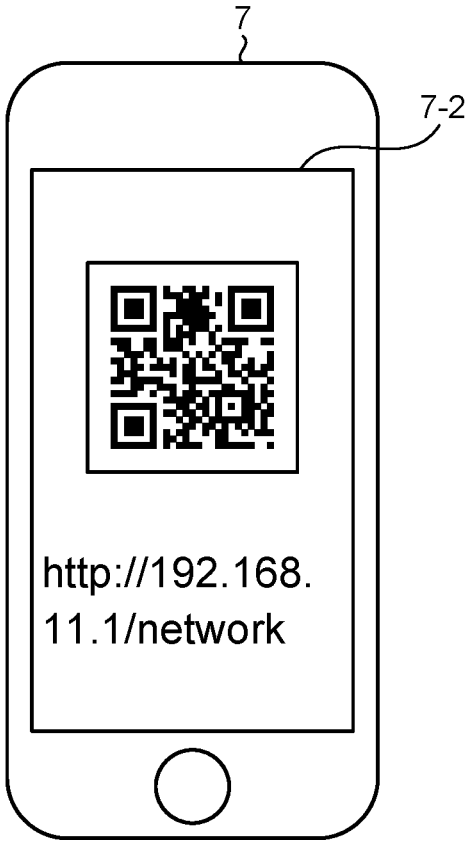
FIG. 22 is a diagram illustrating a state in which an address of a web display unit is input to a display screen of the operation terminal.

FIG. 21 is a diagram illustrating an example of a two-dimensional code assigned to the external connector. In order to simplify input of an address of the web display unit 2-5, a two-dimensional code 2-6 may be assigned to the external connector 2 as illustrated in FIG. 21, and a camera (not illustrated) provided in the operation terminal 7 may be used to read the two-dimensional code 2-6 so that the input, to the operation terminal 7, of the target to connect to can be omitted. The two-dimensional code 2-6 is an example of representation of the target to connect to. FIG. 22 is a diagram illustrating a state in which the address of the web display unit is input to a display screen of the operation terminal. In order to connect the operation terminal 7 to the web display unit 2-5 illustrated in FIG. 2, an address "http://192.168.11.1/network" of the web display unit 2-5 may be directly input on a display screen 7-2 of the operation terminal 7 illustrated in FIG. 22.

Figure 23:
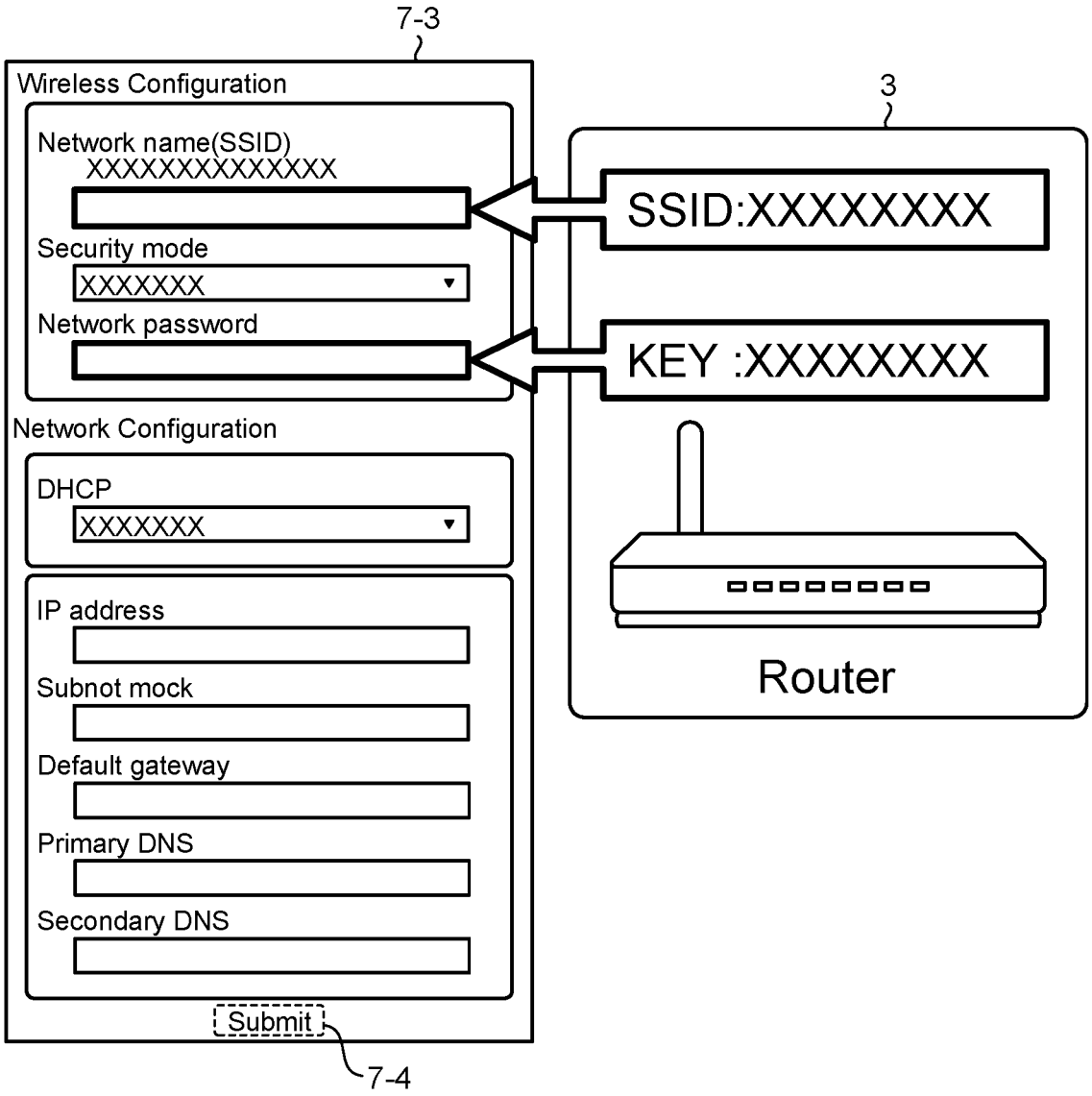
FIG. 23 is a diagram illustrating an example of a network configuration setting screen as a first screen displayed on the operation terminal.

FIG. 23 is a diagram illustrating an example of a network configuration setting screen as a first screen displayed on the operation terminal. FIG. 23 illustrates a case where, while the external connector 2 is connected to the operation terminal 7, SSID and KEY of the router 3 are set so that the configuration setting is changed to connect the external connector 2 to the router 3.

When the operation terminal 7 is connected to the web display unit 2-5, a network configuration setting screen 7-3 as in FIG. 23 is displayed on the operation terminal 7. On the network configuration setting screen 7-3, the operation terminal 7 can input the SSID and KEY to which the wireless communication unit 2-4 is to be connected and can also set IP address and DNS as needed. Then when a submit button 7-4 of the operation terminal 7 is pressed, the input setting information is stored in the wireless communication unit 2-4 of the external connector 2.

Note that the SSID of the router 3 indicated thereon may be directly input to the web display unit 2-5 by using a soft key on the operation terminal 7. Alternatively, as described above, the SSID list of the routers 3 extracted at the time of switching from the router connection mode to the terminal connection mode may be displayed on the web display unit 2-5, and the router 3 to be subjected to the connection setting may be selected from the list so that the time and effort for inputting the SSID can be saved. Still alternatively, a comment "Do you want to connect to the connector?" may be displayed on the web display unit 2-5 so that the connection setting can be performed automatically after the consent of a user is confirmed.

Figure 24:
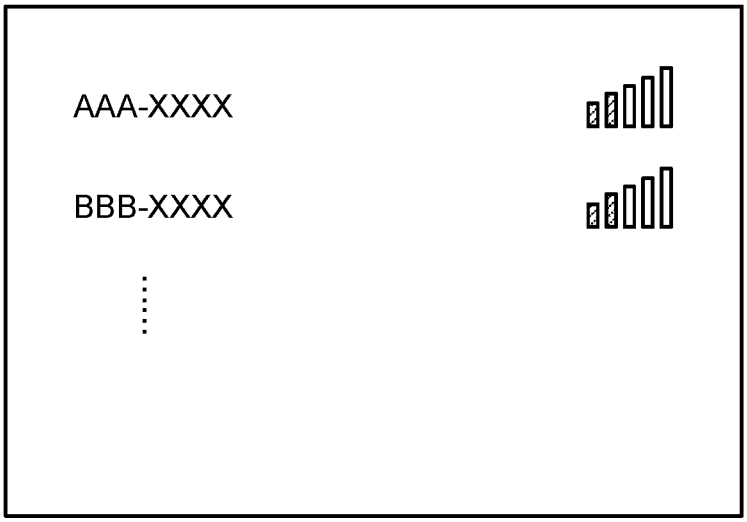
FIG. 24 is a diagram illustrating an example of an SSID list displayed on the web display unit.

FIG. 24 is a diagram illustrating an example of the SSID list displayed on the web display unit. As illustrated in FIG. 24, the web display unit 2-5 displays the SSID list of a plurality of the routers 3. FIG. 24 displays the SSID list of two of the routers 3 as an example. The web display unit 2-5 displays the SSIDs in the SSID list preferably in descending order of signal strength between the external connector 2 and the router 3. Here, depending on the radio environment, even when the router 3 is found once during a search for the routers 3, the signal strength between the external connector 2 and the router 3 may become weak during extraction determination so that the router 3 may not be found, or a plurality of the routers 3 may be extracted. Therefore, if the search for the routers 3 is not completed in the router connection mode, the web display unit 2-5 of the external connector 2 displays the SSIDs obtained by the search completed in a certain period of time in the SSID list, which can solve the problem that the mode is not switched to the terminal connection mode or that it takes too long to switch. Alternatively, even if no router 3 can be searched for in the router connection mode, the external connector 2 may be switched to the terminal connection mode and perform manual input.

After the setting information of the wireless communication unit 2-4 is switched, the external connector 2 switches the mode from the terminal connection mode to the router connection mode, thereby being able to switch the target to connect to from the operation terminal 7 to the router 3. Here, in order for the user to be able to confirm that the connection mode of the external connector 2 has been switched by looking at the LED 26 on the external connector 2, the external connector 2 may change the lighting pattern of the LED 26 in conjunction with the switching of the connection mode.

In addition, the router 3 is generally connected to an Internet line, so that the external connector 2 can be connected to the server 5 via the Internet by connecting the external connector 2 to the router 3 through the communication channel N1 as illustrated in FIG. 15. When the external connector 2 notifies the server 5 of the information of the device to be controlled 1 through the communication channel N1, and the server 5 outputs a reception response to the notification through the communication channel N2, the external connector 2 having received the reception response through the communication channel N2 determines that the connection to the server 5 has succeeded, and then switches the lighting pattern of the LED on the external connector 2 to a pattern indicating the state of server communication. The user can thus determine how the communication state has been switched by looking at just the external connector 2.

Here, when the SSID or KEY of the router 3 is erroneously input at the time the external connector 2 switches the connection mode from the terminal connection mode to the router connection mode, the only way to see whether or not the input is correct is by switching the connection mode to the router connection mode and checking the connection. Moreover, since the connection mode of the external connector 2 is switched, the operation terminal 7 cannot be directly connected to the external connector 2.

In order for the user to be able to determine that the connection mode has been switched to the router connection mode, the external connector 2 switches the lighting pattern of the LED 26. That is, when the external connector 2 is unable to connect to the router 3 due to the setting by the operation terminal 7 in the terminal connection mode, the external connector 2 switches the connection mode to the router connection mode and also changes the lighting pattern of the LED 26 to the lighting pattern indicating the router connection mode. The external connector 2 can thus indicate that the external connector 2 cannot connect to the router 3 even in the router connection mode.

Also, upon acknowledging the inability to connect to the router 3, the external connector 2 may return to the terminal connection mode again and at the same time change the lighting pattern of the LED 26 to the pattern indicating the terminal connection mode, thereby prompting the user to perform the input setting again.

Moreover, in order to inform the user of which input is invalid, the operation terminal 7 may change the font color of an invalid parameter and display a note. Specifically, in a case where the value of KEY is invalid, the operation terminal 7 changes the font color of KEY to a color different from the font color used when the value of KEY is normal.

Next, a detailed description will be made of the operation performed in the aforementioned second case in which the device 1 is operated by connecting the external connector 2 and the operation terminal 7 without via the router 3 and changing the setting of the external connector 2 directly by the operation terminal 7.

Here, in the case where the external connector 2 is connected to the operation terminal 7 via the server 5, the external connector 2 is in a master state of initiating the communication of its own accord. Meanwhile, in the aforementioned second case, the external connector 2 is in a slave state of waiting for an operation request from the operation terminal 7 and returning a response to the operation request upon receiving the operation request.

In the slave state, a specific communication port of hypertext transfer protocol daemon (HTTPd) or UDP is opened, so that the operation terminal 7 is connected to the communication port to be able to directly connect to the external connector 2 at any timing and communicate with the external connector 2. HTTPd is a function on a web server that performs a preset operation such as accepting external connection and transmitting setting information requested, or receiving and saving setting information transmitted.

The web display unit 2-5 illustrated in FIG. 2 includes a first screen for setting network information of the connector 2, a second screen for displaying a state of the device 1, and a third screen for changing the setting of the device 1. Information displayed on these screens of the web display unit 2-5 is transmitted and received to and from the device 1 via the external communication processing unit 2-2. The operation terminal 7 is configured to display the state of the device 1 in the terminal connection mode or to be able to change the setting of the device 1 in the terminal connection mode. As a result, a user of the operation terminal 7 connected to the external connector 2 can check the state of the device 1 and also change the setting information of the device 1.

Note that these screens may be shared with the operation screen 7-1 illustrated in FIG. 3, that is, the screen displayed on the operation terminal 7 by accessing the server 5 and downloading the application.

Also, when the operation terminal 7 is connected to the web display unit 2-5, the IP address set for connecting to the web display unit 2-5 may include a port number added to the IP address as in "http://192.168.1.1:100" or a domain name added to the IP address as in "http://192.168.1.1/setting". Moreover, when the operation terminal 7 is connected to the web display unit 2-5, the connection to the operation screen 7-1 may be restricted by assigning a password so as to limit the user if the setting is confidential. That is, the operation terminal 7 may be configured to request input of a password at the time of connection to the first screen, the second screen, and the third screen of the connector 2.

Note that the operation terminal 7 may be configured to not only perform the setting operation on the device 1 via the external connector 2 but also display the information of the device 1 on the operation terminal 7 so that the user can monitor the state of the device 1. In a case where the operation terminal 7 and the external connector 2 are connected through the communication channel "e" illustrated in FIG. 15, the router 3 is not required so that the operation terminal 7 can solely check the state of the device 1. The operation terminal 7 can thus be used as a service tool even when the router 3 fails or is in a standby power mode. This as a result can reduce the energy consumption of the device control system 100 as a whole, and can also operate the device 1 in an environment before the router 3 is installed to check the operation of the device 1.

In a case where the operation terminal 7 directly changes the setting of the external connector 2 in the terminal connection mode, the operation terminal 7, the external connector 2, and the device 1 are located within the reach of the radio waves. That is, the operation terminal 7, the external connector 2, and the device 1 are not connected through the communication channel N1 or N2 via the network 6 as illustrated in FIG. 15, but are located in a communication range to be able to be operated by an infrared remote control. A user is present near the device 1 in such an environment, so that the device control system 100 set to the terminal connection mode can easily recognize the user and need not manage the operation right as described above. Therefore, the device control system 100 set to the terminal connection mode requires neither the router 3 nor the server 5, and the operation terminal 7 connected to the external connector 2 can carry out the operation in place of the infrared remote control.

Moreover, by using the application set in the operation terminal 7, the operation terminal 7 can implement a device state confirmation screen and a setting information change screen of the web display unit 2-5, whereby a user of the operation terminal 7 can check the state of the device 1 and change the setting information of the device 1.

Figure 25:
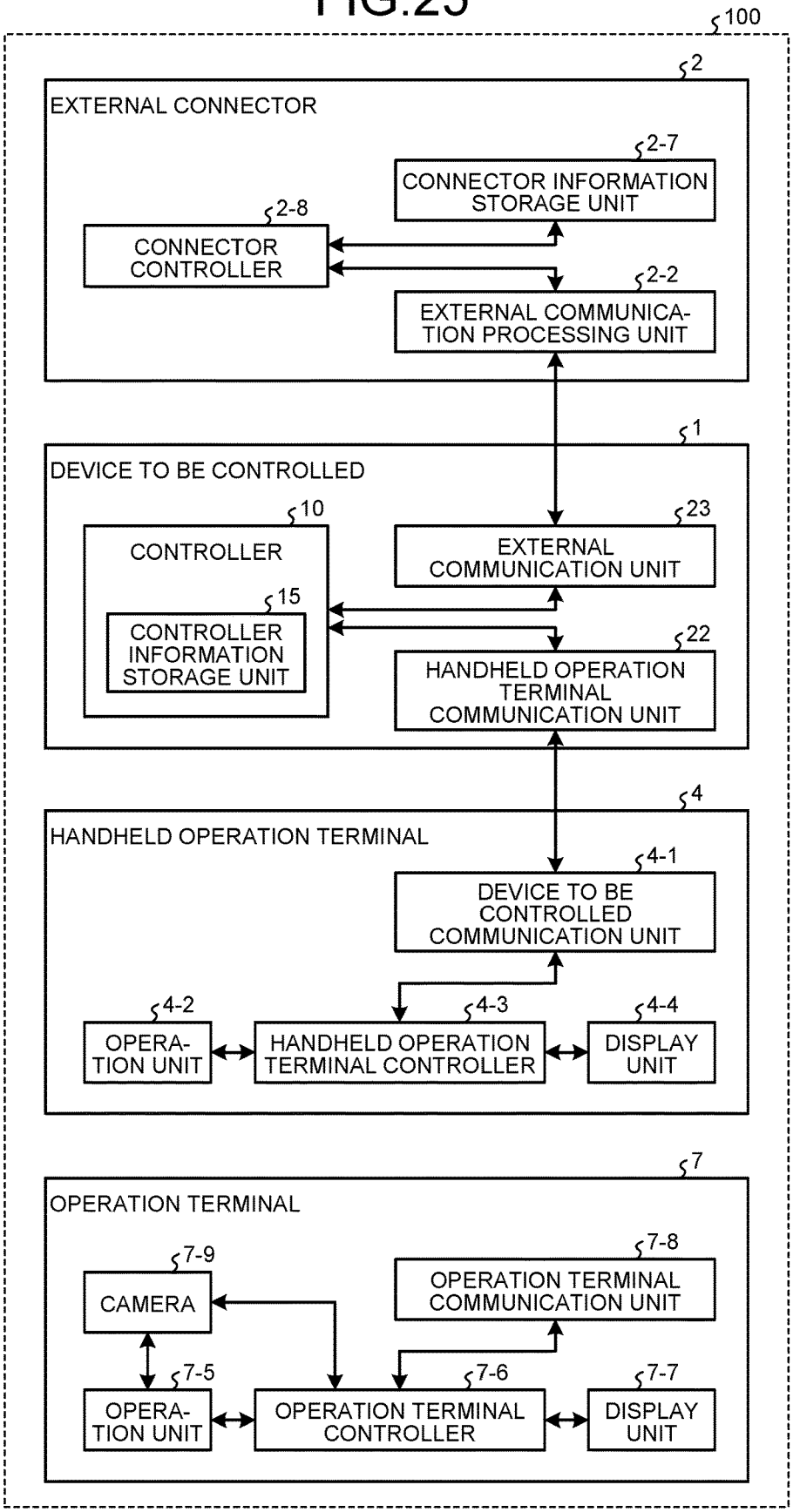
FIG. 25 is a diagram illustrating a configuration related to an operation of displaying information in a connector information storage unit on a handheld operation terminal.

Next, another function of the device control system 100 will be described. Hereinafter, a function will be described in which the handheld operation terminal 4 selectively displays, on a display unit 4-4, information necessary for connecting the operation terminal 7 to the external connector 2 or information necessary for registering the external connector 2 to the server 5. FIG. 25 is a diagram illustrating a configuration related to an operation of displaying information in a connector information storage unit on the handheld operation terminal. Note that FIG. 25 also illustrates a configuration of the operation terminal 7.

The external connector 2 in the device control system 100 includes a connector information storage unit 2-7 and a connector controller 2-8 in addition to the configuration of the external connector 2 in the device control system 100 described above.

The connector information storage unit 2-7 is configured such that, as illustrated in FIG. 21, the connection information of the external connector 2 held by the external connector 2, that is, the connection information for connecting the operation terminal 7 to the external connector 2, is written in a non-volatile area of the connector information storage unit 2-7 at the time of production of the external connector 2 and is stored therein before shipment of the external connector 2. The connector information storage unit 2-7 can exchange information with other components of the external connector 2. The connection information for connecting the operation terminal 7 to the external connector 2 includes, as illustrated in FIG. 21, information such as MAC information, ID information, SSID information, and KEY information about the external connector 2. The MAC information is synonymous with the MAC address described above.

The connector controller 2-8 controls the overall operation of the external connector 2. Moreover, the connector controller 2-8 controls processing related to transmission and reception of information.

The controller 10 of the device to be controlled 1 includes a controller information storage unit 15. In a case where the device to be controlled 1 is an air conditioner, the controller information storage unit 15 stores information such as an operating mode and a set temperature set by the handheld operation terminal 4. The handheld operation terminal communication unit 22 of the device to be controlled 1 communicates with the handheld operation terminal 4 to transmit and receive the information stored in the controller information storage unit 15.

The operation terminal 7 includes an operation unit 7-5, an operation terminal controller 7-6, a display unit 7-7, an operation terminal communication unit 7-8, and a camera 7-9.

The operation unit 7-5 accepts an operation related to control of the device to be controlled 1 from a user. When accepting the operation from the user, the operation unit 7-5 transmits operation details corresponding to the user's operation to the operation terminal controller 7-6.

The operation terminal controller 7-6 controls the operation terminal 7 on the basis of the operation details of the user's operation accepted by the operation unit 7-5. Moreover, on the basis of the operation details of the operation performed on the operation unit 7-5, the operation terminal controller 7-6 controls communication with another device, transmission and reception of information to and from another device, and display of information on the display unit 7-7.

The display unit 7-7 displays various types of information on the basis of an operation on the operation unit 7-5 or control of the operation terminal controller 7-6.

The operation terminal communication unit 7-8 communicates with another device to transmit and receive information.

The camera 7-9 performs various types of imaging on the basis of an operation on the operation unit 7-5 or control of the operation terminal controller 7-6. The camera 7-9 transmits imaging data captured to the operation terminal controller 7-6.

The handheld operation terminal 4 includes a device to be controlled communication unit 4-1, an operation unit 4-2, a handheld operation terminal controller 4-3, and the display unit 4-4.

The device to be controlled communication unit 4-1 communicates with the device to be controlled 1 to transmit and receive information.

The operation unit 4-2 accepts an operation related to control of the device to be controlled 1 from a user. When accepting the operation from the user, the operation unit 4-2 transmits operation details corresponding to the user's operation to the handheld operation terminal controller 4-3.

The display unit 4-4 displays various types of information on the basis of an operation on the operation unit 4-2 or control of the handheld operation terminal controller 4-3.

The handheld operation terminal controller 4-3 controls the handheld operation terminal 4 on the basis of the operation details of the user's operation accepted by the operation unit 4-2. The handheld operation terminal controller 4-3 transmits the operation details of the operation performed on the operation unit 4-2 to the display unit 4-4 and causes the display unit 4-4 to display the operation details, and also transmits the operation details to the handheld operation terminal communication unit 22 of the device to be controlled 1 via the device to be controlled communication unit 4-1. A communication system between the handheld operation terminal communication unit 22 and the device to be controlled communication unit 4-1 uses near infrared light beams as the carrier wave, as described above. Infrared communication between the handheld operation terminal communication unit 22 and the device to be controlled communication unit 4-1 is not one-way communication but two-way communication that allows information to be transmitted from the device to be controlled communication unit 4-1 to the handheld operation terminal communication unit 22 and allows information to be transmitted from the handheld operation terminal communication unit 22 to the device to be controlled communication unit 4-1.

Figure 26:
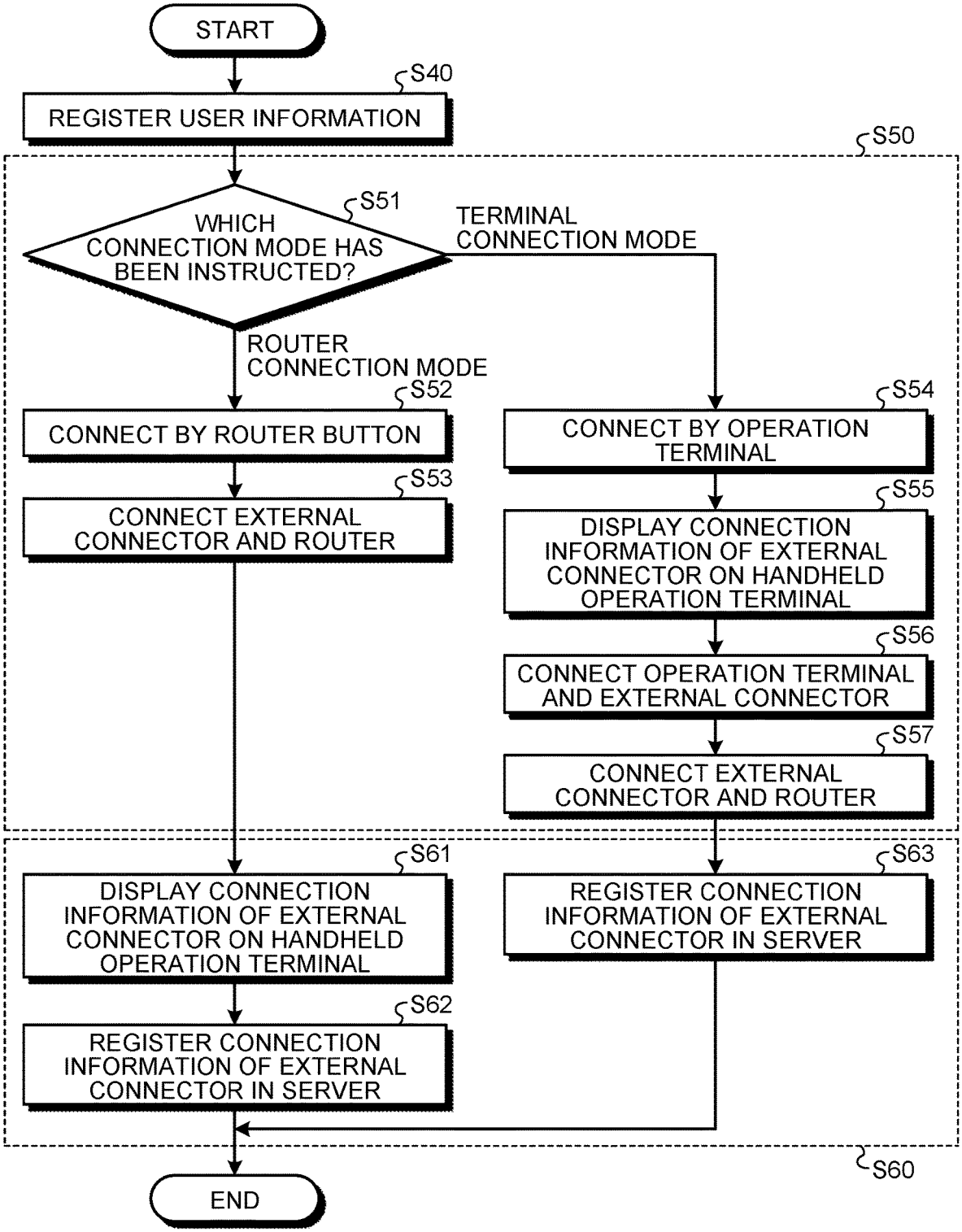
FIG. 26 is a flowchart illustrating steps of connection and procedure necessary for remote operation of a device in the device control system.

Next, a description will be made of a procedure of connection and registration necessary for using a remote operation service of the device to be controlled 1 as illustrated in FIG. 1 in the device control system 100. FIG. 26 is a flowchart illustrating steps of connection and procedure necessary for remote operation of the device in the device control system. The connection and procedure necessary for the remote operation of the device to be controlled 1 in the device control system 100 are connection of the operation terminal 7 to the external connector 2 and registration of the external connector 2 in the server 5. As described above, the server 5 manages the operation right of the operation terminal 7 for operating the device to be controlled 1. That is, the server 5 manages the operation terminal 7 that is a wireless operation terminal for operating the wireless device 200.

First, user registration for registering user information is performed, the user information being information of a user who uses the device control system 100 by remote operation (step S40). The user registration is performed by the user using the application of the operation terminal 7 and registering account information, which is the user information, in the database server 5-2 from the operation terminal 7. The account information is user identification information for identifying a plurality of users who uses the device control system 100 by remote operation. The account information for identifying the plurality of users may be e-mail addresses belonging to the users, or may be arbitrary names uniquely given by the users to the remote operation service of the device to be controlled 1. Note that the account information is managed in the database server 5-2 so as not to overlap among the users.

Next, the external connector 2 is connected (step S50). First, the external connector 2 determines which connection mode has been instructed (step S51). Specifically, the connector controller 2-8 of the external connector 2 determines whether the mode selector switch has been pressed for a time required for switching to the router connection mode. That is, as described above, the external connector 2 operates in either the router connection mode that is the first connection mode in which the external connector 2 and the terminal 7 are connected via the router 3, or the terminal connection mode that is the second connection mode in which the external connector 2 and the terminal 7 are connected without the router 3.

The switch 25, which is the mode selector switch provided in the external connector 2, has a function as a switching unit for switching the external connector 2 between the router connection mode that is the first connection mode in which the external connector 2 is wirelessly connected to the operation terminal 7, which is the wireless operation terminal, via the wireless LAN router 3, and the terminal connection mode that is the second connection mode in which the external connector 2 is wirelessly connected directly to the operation terminal 7, which is the wireless operation terminal, without via the wireless LAN router 3.

If the switch 25 that is the mode selector switch has been pressed for a preset period of time to switch to the router connection mode, the connector controller 2-8 of the external connector 2 determines that the router connection mode has been instructed, controls to switch to the router connection mode, and proceeds to step S52. The preset period of time to switch to the router connection mode is, for example, one second or longer and less than five seconds.

If the external connector 2 is switched to the router connection mode, the external connector 2 and the wireless LAN router 3 are connected by using a button of the wireless LAN router 3 (step S52). Specifically, a connection button (not illustrated) provided on the wireless LAN router 3 is pressed. As a result, the external connector 2 is connected to the wireless LAN router 3 and can communicate with the wireless LAN router 3 (step S53). Note that the connection between the external connector 2 and the wireless LAN router 3 by pressing the connection button of the wireless LAN router 3 can be performed by a known technique.

On the other hand, if the switch 25 has been pressed for a preset period of time to switch to the terminal connection mode, the connector controller 2-8 of the external connector 2 determines that the terminal connection mode has been instructed, controls to switch to the terminal connection mode, and proceeds to step S54. The preset period of time to switch to the terminal connection mode is, for example, five second or longer and less than ten seconds.

If the external connector 2 is switched to the terminal connection mode, the external connector 2 and the operation terminal 7 are connected by the operation terminal 7 (step S54). As described with reference to FIG. 19, the wireless communication unit 2-4 of the external connector 2 searches for one or a plurality of the routers 3 located around the external connector 2, and lists the network information, namely the SSID, of the one or plurality of the routers 3 extracted. After the SSIDs are listed, the SSID and KEY as the connection information of the external connector 2 need to be input on the operation terminal 7.

Figure 27:
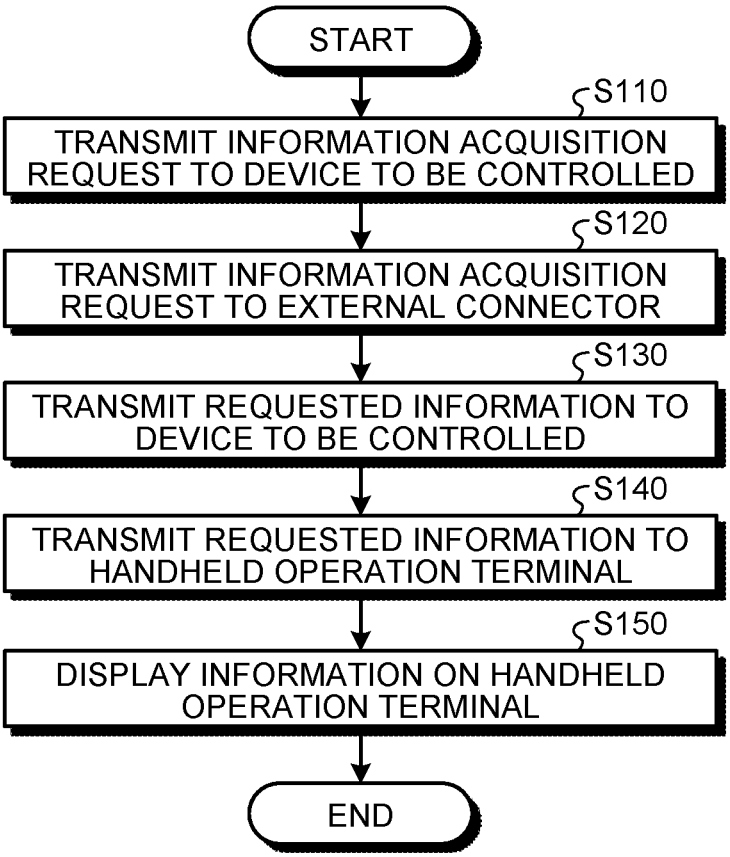
FIG. 27 is a flowchart of an operation in which the handheld operation terminal acquires information stored in the external connector and displays the information on a display unit.

Here, a description will be made of an operation in which the handheld operation terminal 4 acquires various types of information stored in the external connector 2 and displays the information on the display unit 4-4. FIG. 27 is a flowchart of the operation in which the handheld operation terminal acquires the information stored in the external connector and displays the information on the display unit.

First, the handheld operation terminal 4 transmits an information acquisition request to the device to be controlled 1 (step S110). For example, in a case where information such as the MAC information stored in the connector information storage unit 2-7 of the external connector 2 is to be acquired by the handheld operation terminal 4, for example, a MAC information acquisition command is prepared in advance in the handheld operation terminal controller 4-3 of the handheld operation terminal 4, the MAC information acquisition command being the information acquisition request instructing acquisition of the MAC information stored in the connector information storage unit 2-7 of the external connector 2. Then, when the MAC information acquisition command is operated on the operation unit 4-2 of the handheld operation terminal 4, the handheld operation terminal controller 4-3 transmits the MAC information acquisition command to the handheld operation terminal communication unit 22 via the device to be controlled communication unit 4-1. The handheld operation terminal controller 4-3 further causes the display unit 4-4 of the handheld operation terminal 4 to display that the MAC information stored in the connector information storage unit 2-7 of the external connector 2 is being acquired.

Next, the device to be controlled 1 transmits an information acquisition request to the external connector 2 (step S120). The handheld operation terminal communication unit 22 of the device to be controlled 1 receives the MAC information acquisition command and transmits the MAC information acquisition command to the controller 10 of the device to be controlled 1. The controller 10 transmits the MAC information acquisition command to the external communication processing unit 2-2 of the external connector 2 via the external communication unit 23.

Next, the external connector 2 transmits information requested by the information acquisition request to the device to be controlled 1 (step S130). The external communication processing unit 2-2 of the external connector 2 receives the MAC information acquisition command and transmits the MAC information acquisition command to the connector controller 2-8 of the external connector 2. The connector controller 2-8 transmits, as a response to the MAC information acquisition command, the MAC information stored in the connector information storage unit 2-7 to the external communication unit 23 of the device to be controlled 1 via the external communication processing unit 2-2. Note that the transmission, which is based on the MAC information acquisition command, of the information stored in the connector information storage unit 2-7 may be performed by the connector information storage unit 2-7 as a main actor.

Next, the device to be controlled 1 transmits the information requested by the information acquisition request to the handheld operation terminal 4 (step S140). The external communication unit 23 of the device to be controlled 1 receives the MAC information and transmits the MAC information to the controller 10 of the device to be controlled 1. The controller 10 receives the MAC information and stores the MAC information in the controller information storage unit 15. Moreover, as a response to the MAC information acquisition command, the controller 10 transmits the MAC information to the device to be controlled communication unit 4-1 of the handheld operation terminal 4 via the handheld operation terminal communication unit 22.

Next, the handheld operation terminal 4 displays the information requested by the information acquisition request (step S150). The device to be controlled communication unit 4-1 of the handheld operation terminal 4 receives the MAC information and transmits the MAC information to the handheld operation terminal controller 4-3 of the handheld operation terminal 4. The handheld operation terminal controller 4-3 receives the MAC information, transmits the MAC information to the display unit 4-4 of the handheld operation terminal 4, and causes the display unit 4-4 to display the MAC information.

As described above, the handheld operation terminal controller 4-3 of the handheld operation terminal 4 transmits the information acquisition request to the external connector 2 on the basis of the operation details of the operation performed on the operation unit 4-2, thereby being able to acquire desired information from the external connector 2 and cause the display unit 4-4 to display the information.

Note that in the example described herein, the handheld operation terminal 4 acquires the MAC address stored in the connector information storage unit 2-7 of the external connector 2 and displays the MAC address on the display unit 4-4, but the information that the handheld operation terminal 4 can acquire and display on the display unit 4-4 is not limited to the MAC address. That is, by performing processing similar to that described above, the handheld operation terminal controller 4-3 of the handheld operation terminal 4 can acquire various types of information stored in the connector information storage unit 2-7 of the external connector 2 or the controller information storage unit 15 in the controller 10 of the device to be controlled 1, that is, various types of information from the wireless device 200, and display the information on the display unit 4-4.

Here, the various types of information include first information that is information necessary for connecting the operation terminal 7, which is the wireless operation terminal, to the external connector 2, and second information that is information registered in the server 5 for operating the device to be controlled 1 by the operation terminal 7 that is the wireless operation terminal.

Moreover, in the example described herein, the information stored in the connector information storage unit 2-7 of the external connector 2 is stored in the controller information storage unit 15 when the operation unit 4-2 of the handheld operation terminal 4 accepts the operation of the information acquisition request, but the processing of storage, in the controller information storage unit 15, of the information stored in the connector information storage unit 2-7 is not limited to this example. For example, as long as the external communication processing unit 2-2 of the external connector 2 and the external communication unit 23 of the device to be controlled 1 are in a communicable state, the information in the connector information storage unit 2-7 may be transmitted to the controller information storage unit 15 and stored in the controller information storage unit 15 even when the operation of the information acquisition request is not performed on the operation unit 4-2.

The description refers back to FIG. 26. When operations similar to those in steps S110 to S150 described above are performed, the SSID and KEY as the connection information of the external connector 2 are displayed on the display unit 4-4 of the handheld operation terminal 4 (step S55). The connection information of the external connector 2 here is the first information that is the information necessary for connecting the operation terminal 7, which is the wireless operation terminal, to the external connector 2.

Then, as described with reference to FIG. 20, when the SSID and KEY as the connection information of the external connector 2 are input to the operation terminal 7, the external connector 2 is selected as the target to which the operation terminal 7 is wirelessly connected, and the wireless communication unit 2-4 of the external connector 2 is wirelessly connected to the operation terminal 7 (step S56).

Next, after step S56, the external connector 2 and the wireless LAN router 3 are connected as in step S53 described above (step S57). The connection between the external connector 2 and the wireless LAN router 3 can be performed by rewriting, from the operation terminal 7 connected to the wireless communication unit 2-4 of the external connector 2 in step S56, the information held in the external connector 2 and indicating the target to which the external connector 2 is connected such that the external connector 2 is connected to the wireless LAN router 3. In this case, the operation terminal 7 prepares in advance application software with which, in order for the external connector 2 to be connected to the wireless LAN router 3, the operation terminal 7 can rewrite the information held in the external connector 2 and indicating the target to which the external connector 2 is connected. That is, the operation terminal 7 need include the application software with which, in order for the wireless LAN router 3 to be the target to which the external connector 2 is wirelessly connected, the operation terminal 7 can rewrite the information held in the external connector 2 and indicating the target to which the external connector 2 is connected.

Moreover, in a case where the operation terminal 7 has been connected to the wireless LAN router 3 in the past, the connection between the external connector 2 and the wireless LAN router 3 can be performed by using the connection information in a connection history between the operation terminal 7 and the wireless LAN router 3 and rewriting the information held in the external connector 2 and indicating the target to which the external connector 2 is connected such that the external connector 2 is connected to the wireless LAN router 3. In this case, the operation terminal 7 prepares in advance application software with which the operation terminal 7 connected to the wireless communication unit 2-4 of the external connector 2 in step S56 can rewrite the information, which indicates the target to which the external connector 2 is connected, to the connection information between the operation terminal 7 and the wireless LAN router 3 in the connection history between the operation terminal 7 and the wireless LAN router 3 held in the external connector 2. That is, the operation terminal 7 need include the application software with which, in order for the wireless LAN router 3 to be the target to which the external connector 2 is wirelessly connected, the operation terminal 7 can rewrite the information, which is held in the external connector 2 and indicates the target to which the external connector 2 is connected, to the connection information between the operation terminal 7 and the wireless LAN router 3 in the connection history between the operation terminal 7 and the wireless LAN router 3.

Figure 28:
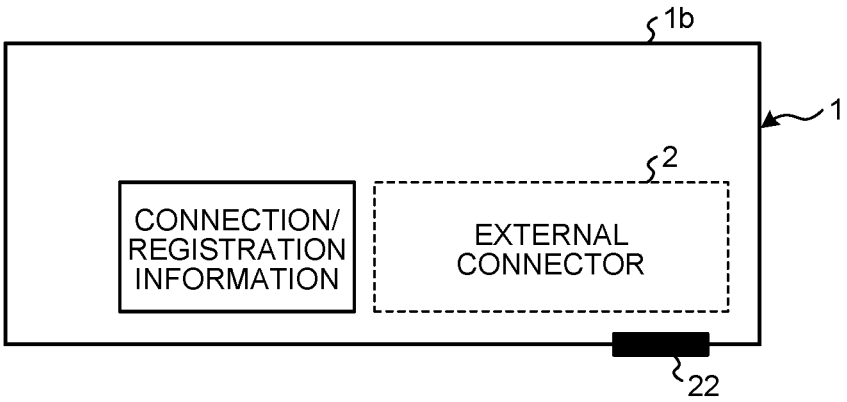
FIG. 28 is a schematic diagram illustrating the device to be controlled in which the external connector is incorporated.

FIG. 28 is a schematic diagram illustrating the device to be controlled in which the external connector is incorporated. FIG. 28 illustrates a state in which the external connector 2 is built in a housing 1*b* of the device to be controlled 1, and a label of connection/registration information is attached to a side surface of the housing 1*b*. The connection information of the external connector 2, that is, the connection information for connecting the operation terminal 7 to the external connector 2, may be attached to the external connector 2. The connection information for connecting the operation terminal 7 to the external connector 2 can be rephrased as connection information necessary for connecting the operation terminal 7 in the terminal connection mode. Also, in a case where the external connector 2 is built in the device to be controlled 1 as illustrated in FIG. 28, the connection information for connecting the operation terminal 7 to the external connector 2 may be attached to the device to be controlled 1 as the connection/registration information as illustrated in FIG. 21. The connection/registration information includes information necessary for connecting the operation terminal 7, which is the wireless operation terminal, to the external connector 2, and information registered in the server 5 for operation of the device to be controlled 1 by the operation terminal 7 that is the wireless operation terminal. In a case where the device to be controlled 1 is disposed at a high place, such as in a case where the device to be controlled 1 is an air conditioner, it is difficult to check the connection/registration information attached to the device to be controlled 1.

Moreover, in a case where the external connector 2 is built in the device to be controlled 1, there is a case where the switch 25 that is the mode selector switch of the external connector 2 cannot be pressed, or the LED 26 is not visible. In this case, the operation unit 4-2 of the handheld operation terminal 4 can be substituted for the switch operation of the switch 25 on the external connector 2.

In the case where the operation unit 4-2 of the handheld operation terminal 4 is substituted for the switch operation of the switch 25 on the external connector 2, a mode switching command, which is a mode switching request for instructing the external connector 2 to be in the terminal connection mode, is prepared in advance in the handheld operation terminal controller 4-3 of the handheld operation terminal 4. The mode switching request is a request for switching the connection mode. As a result, when the mode switching command is operated on the operation unit 4-2, the handheld operation terminal controller 4-3 transmits the mode switching request from the handheld operation terminal 4 to the external connector 2, so that the connection mode of the external connector 2 can be switched to the terminal connection mode.

That is, the wireless communication unit 2-4 of the external connector 2 receives the mode switching command transmitted from the handheld operation terminal controller 4-3 of the handheld operation terminal 4, and transmits the mode switching command to the connector controller 2-8 of the external connector 2. The connector controller 2-8 receives the mode switching command and performs control to switch the connection mode of the external connector 2 to the terminal connection mode. In addition, a mode switching request for instructing the external connector 2 to be in the router connection mode may be provided as the mode switching command. As described above, the handheld operation terminal 4 and the external connector 2 have a function as a switching unit for switching the external connector 2 between the router connection mode that is the first connection mode in which the external connector 2 is wirelessly connected to the operation terminal 7, which is the wireless operation terminal, via the wireless LAN router 3, and the terminal connection mode that is the second connection mode in which the external connector 2 is wirelessly connected directly to the operation terminal 7, which is the wireless operation terminal, without via the wireless LAN router 3.

Moreover, when transmitting the mode switching command to the external connector 2, the handheld operation terminal 4 can display the connection information of the external connector 2 on the display unit 4-4 by performing operations similar to those of step S110 to step S150 described above, the connection information of the external connector 2 being stored in the connector information storage unit 2-7 of the external connector 2 or the controller information storage unit 15 in the controller 10 of the device to be controlled 1. As a result, the handheld operation terminal 4 can easily acquire the connection information for connecting the operation terminal 7 to the external connector 2. Therefore, the handheld operation terminal 4 can easily acquire the connection information for connecting the operation terminal 7 to the external connector 2 when the external connector 2 is in the terminal connection mode.

For the device to be controlled 1 incorporating the external connector 2 as illustrated in FIG. 28, the information necessary for connection and registration to the external connector 2 as in FIG. 21 can be checked on the display unit 4-4, whereby the workability is improved when a user connects the operation terminal 7 to the external connector 2 and performs registration necessary for connecting the operation terminal 7 to the external connector 2. Moreover, since the information necessary for connection and registration to the external connector 2 as in FIG. 21 can be checked on the display unit 4-4, the label of the connection/registration information as illustrated in FIG. 28 need not be attached to the device to be controlled 1 so that the labelling process can be omitted.

Figure 29:
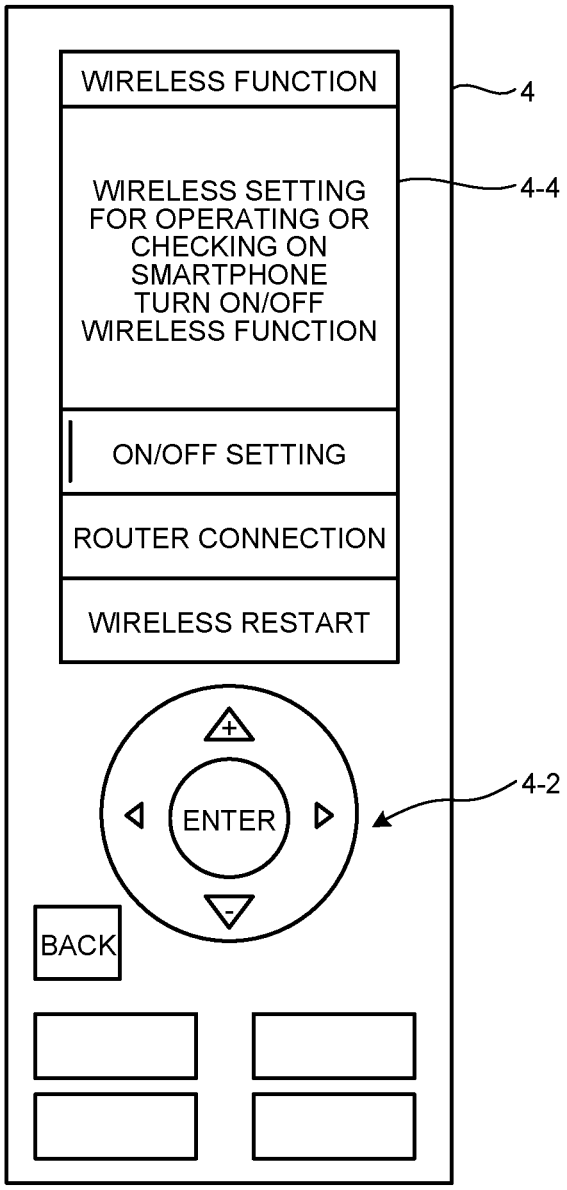
FIG. 29 is a first diagram illustrating an example of an operation unit and the display unit of the handheld operation terminal.
Figure 30:
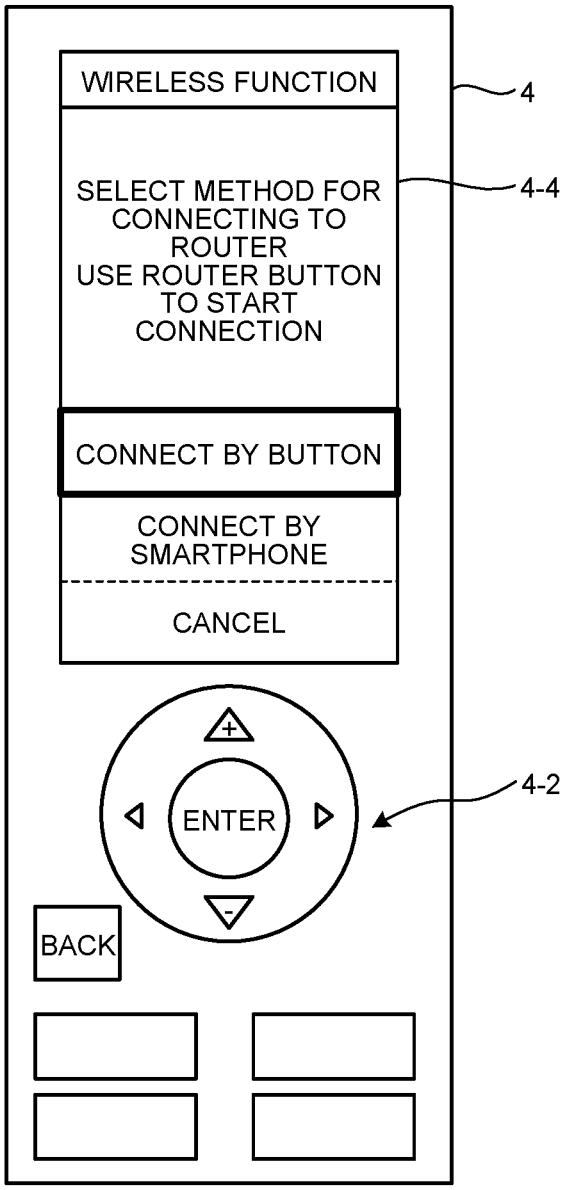
FIG. 30 is a second diagram illustrating an example of the operation unit and the display unit of the handheld operation terminal.
Figure 31:
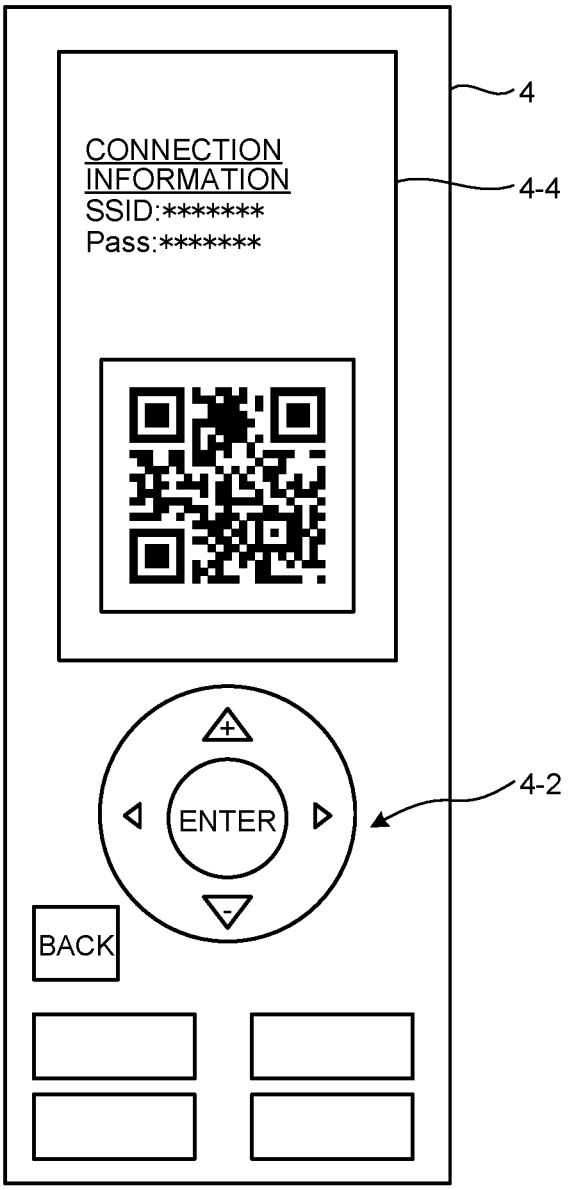
FIG. 31 is a diagram illustrating an example of connection information displayed on the display unit of the handheld operation terminal.

FIG. 29 is a first diagram illustrating an example of the operation unit and the display unit of the handheld operation terminal. FIG. 30 is a second diagram illustrating an example of the operation unit and the display unit of the handheld operation terminal. FIG. 31 is a diagram illustrating an example of the connection information displayed on the display unit of the handheld operation terminal.

In a case where the external connector 2 is provided separately from the device to be controlled 1, instead of being built in the housing 1*b* of the device to be controlled 1, the external connector 2 is constantly powered, and the wireless communication unit 2-4 keeps emitting radio waves.

On the other hand, in the case where the external connector 2 is built in the device to be controlled 1 as illustrated in FIG. 28, the handheld operation terminal 4 is connected to the external connector 2 so as to be able to switch on and off the power supply to the external connector 2 and select whether or not to use the wireless function of the external connector 2. On the handheld operation terminal 4, as illustrated in FIG. 29, the display unit 4-4 displays a screen regarding the wireless function of the external connector 2. For the screen illustrated in FIG. 29, a user operates the operation unit 4-2 of the handheld operation terminal 4 to be able to switch on and off the power supply to the external connector 2 and select whether or not to use the wireless function of the external connector 2. Specifically, on the screen illustrated in FIG. 29, a setting screen for selecting whether to turn on or off the wireless function of the external connector 2 is displayed on the display unit 4-4.

The handheld operation terminal controller 4-3 of the handheld operation terminal 4 transmits a wireless function selection command for selecting whether to turn on or off the wireless function of the external connector 2 set on the screen illustrated in FIG. 29 to the connector controller 2-8 of the external connector 2 via the device to be controlled communication unit 4-1, the handheld operation terminal communication unit 22 of the device to be controlled 1, the controller 10 of the device to be controlled 1, the external communication unit 23 of the device to be controlled 1, and the external communication processing unit 2-2 of the external connector 2. The connector controller 2-8 of the external connector 2 controls on/off of the wireless function of the external connector 2 on the basis of the wireless function selection command.

For example, in a case where a pacemaker user or the like wants to use the device to be controlled 1 but wants to stop the wireless communication between the operation terminal 7 and the external connector 2, the wireless function of the external connector 2 can be stopped by connecting the handheld operation terminal 4 to the external connector 2. Meanwhile, in order to use the function of FIG. 30, the wireless function of the external connector 2 needs to be turned "ON" using the screen illustrated in FIG. 29.

Moreover, on the handheld operation terminal 4, in a case where there are two methods of connecting the external connector 2 to the wireless LAN router 3, a screen for selecting which connection method to use is displayed on the display unit 4-4 as illustrated in FIG. 30, the two methods including a "method of connection using the button of the router 3" and a "method of connection using a smartphone". Here, the smartphone corresponds to the operation terminal 7.

In FIG. 30, "connect by button" corresponds to the "method of connection using the button of the router 3", and is a connection method using a function such as WiFi Protected Setup (WPS) of the wireless LAN router 3 when the external connector 2 has the switch 25. By the "method of connection using the button of the router 3", the external connector 2 and the operation terminal 7 are connected to the router 3 through the communication channels "a" and "b" illustrated in FIG. 15. That is, the external connector 2 and the operation terminal 7 are connected in the "router connection mode".

Moreover, "connect by smartphone" in FIG. 30 corresponds to the "method of connection using a smartphone", in which case the operation terminal 7 is directly connected to the external connector 2 through the communication channel "e" illustrated in FIG. 15. That is, the external connector 2 and the operation terminal 7 are connected in the "terminal connection mode" in which the operation terminal 7 is directly connected to the device to be controlled 1 or the external connector 2 without via the wireless LAN router 3.

In a case where the external connector 2 is built in the device to be controlled 1 and the switch 25 cannot be pressed, a user operates the operation unit 4-2 of the handheld operation terminal 4 so as to be able to select, on the screen illustrated in FIG. 30, either the "router connection mode" or the "terminal connection mode" for the connection mode of the external connector 2 on the handheld operation terminal 4. A connection mode selection command for selecting either the "router connection mode" or the "terminal connection mode" is transmitted to the connector controller 2-8 of the external connector 2 as is the case with the wireless function selection command described above. The connector controller 2-8 of the external connector 2 controls the connection mode of the external connector 2 on the basis of the connection mode selection command.

Therefore, the handheld operation terminal 4 can turn "ON" the wireless function of the external connector 2 using the screen illustrated in FIG. 29, and set the connection mode of the external connector 2 to the "terminal connection mode" on the screen illustrated in FIG. 30.

When the terminal connection mode is designated by the operation unit 4-2 of the handheld operation terminal 4, the device to be controlled communication unit 4-1 transmits a connection information request for requesting connection information necessary for connection in the terminal connection mode to the handheld operation terminal communication unit 22 of the device to be controlled 1. That is, by performing operations similar to those in step S110 to step S150 described above, the handheld operation terminal 4 can acquire the connection information of the external connector 2, which is the connection information necessary for connection in the terminal connection mode, and can display the connection information on the display unit 4-4.

In a state in which the connection mode of the external connector 2 is switched to the terminal connection mode by the mode switching request from the handheld operation terminal 4, when the user inputs the connection information of the external connector 2 displayed on the display unit 4-4 to the operation terminal 7, the external connector 2 is selected as the target to which the operation terminal 7 is wirelessly connected, and the wireless communication unit 2-4 of the external connector 2 is wirelessly connected to the operation terminal 7. In this case, the connection mode of the operation terminal 7 is manually switched to the terminal connection mode on the operation terminal 7 before the connection information of the external connector 2 is input thereto.

The connection information necessary for connecting the operation terminal 7 in the terminal connection mode may be displayed as text as in FIG. 31 or may be displayed as a matrix code as in FIG. 31. The connection information necessary for connecting the operation terminal 7 in the terminal connection mode can be rephrased as the connection information for connecting the operation terminal 7 to the external connector 2, as described above. The operation terminal 7 reads imaging data of the matrix code captured by the camera 7-9, converts the matrix code into text information, and recognizes the text information. The information necessary for connecting the operation terminal 7 in the terminal connection mode is selectively displayed on the display unit 4-4 of the handheld operation terminal 4, so that the user can easily check only the information necessary for connecting the operation terminal 7 in the terminal connection mode and input the information to the operation terminal 7.

The handheld operation terminal 4 selectively displays the information necessary for connection in the terminal connection mode on the display unit 4-4, so that a display area of the connection information necessary for connecting the operation terminal 7 in the terminal connection mode can be reduced. Also, the operation terminal 7 reads the matrix code selectively including the information necessary for connecting the operation terminal 7 in the terminal connection mode, so that only the information necessary for connecting the operation terminal 7 in the terminal connection mode can be selectively displayed on the display unit 7-7 of the operation terminal 7. Moreover, the operation terminal 7 selectively displays the connection information necessary for connecting the operation terminal 7 in the terminal connection mode on the display unit 7-7, so that the user can selectively and easily check the information necessary for connection in the terminal connection mode.

The description refers back to FIG. 26. Finally, the information of the external connector 2 is registered in the server 5, and the user information registered in step S40 is associated with the information of the external connector 2 (step S60). As a result, among a plurality of the devices to be controlled 1 connected to the external connector 2 or a plurality of the devices to be controlled 1 incorporating the external connector 2, only the device to be controlled 1 associated with the user information can be remotely operated by the operation terminal 7.

Figure 32:
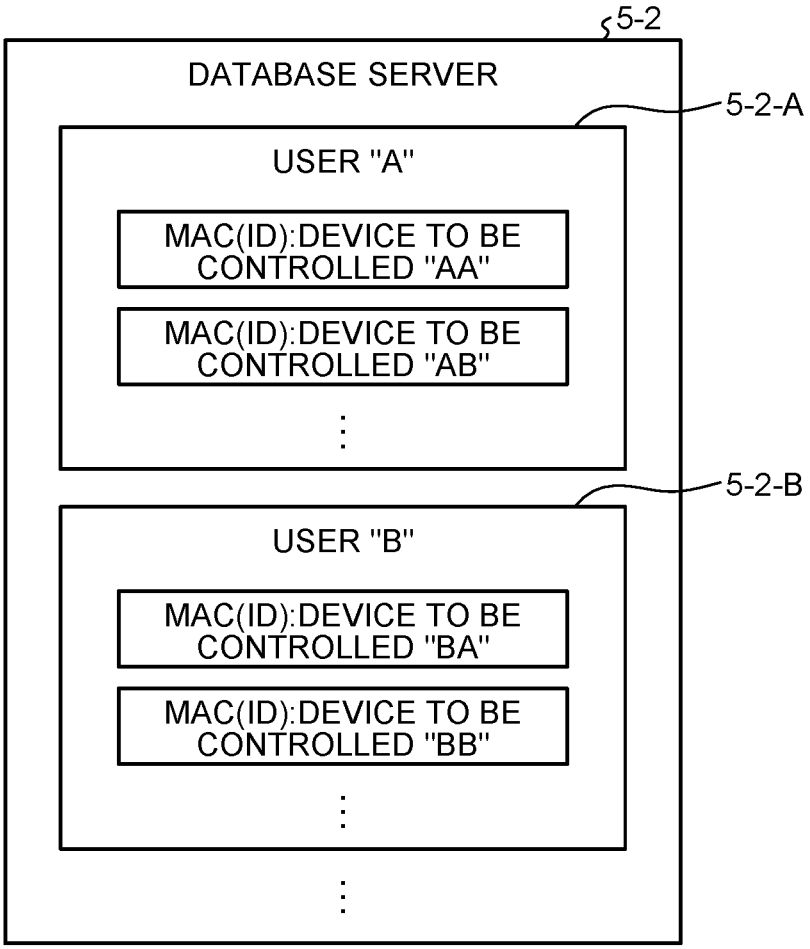
FIG. 32 is a diagram illustrating an example of information registered on a database server of a server.

FIG. 32 is a diagram illustrating an example of the information registered on the database server of the server. As illustrated in FIG. 32, the user information of a plurality of users is registered on the database server 5-2 of the server 5, the user information including user information 5-2-A that is the user information of a user "A" and user information 5-2-B that is the user information of a user "B". The user information of each user is associated with MAC information and ID information of the device to be controlled 1. For example, in the user information of the user "A", a device to be controlled "AA" and a device to be controlled "AB" are registered as the MAC information that is unique information, so that the user "B" does not operate the device to be controlled "AA".

For the purpose of convenience, FIG. 32 illustrates the MAC information of the device to be controlled "AA" as "device to be controlled AA", and the MAC information of the device to be controlled "AB" as "device to be controlled AB". Note that the ID information is used for verification at the time of registering the information of the external connector 2 in the server 5, and is used as key information for preventing erroneous registration of the information of the external connector 2 in the server 5 and for preventing a malicious third party from impersonating an authorized user and registering the information of the external connector 2 in the server 5. Therefore, the information associated with the user information may be only the MAC information.

Figure 33:
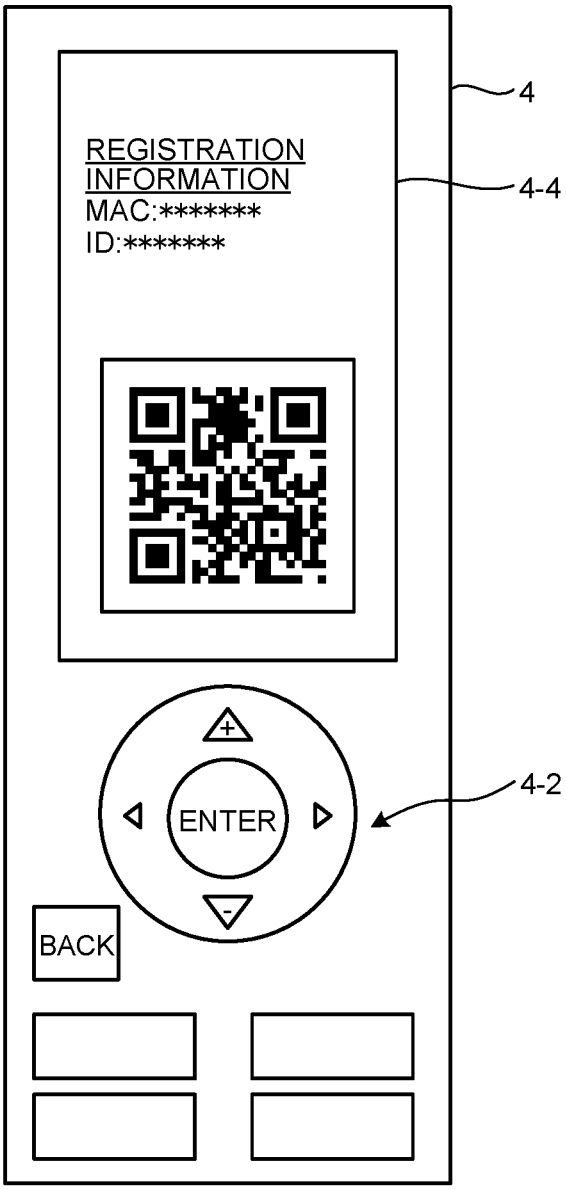
FIG. 33 is a diagram illustrating an example of a display screen on the display unit of the handheld operation terminal.

FIG. 33 is a diagram illustrating an example of a display screen on the display unit of the handheld operation terminal. Step S60 will be specifically described. As illustrated in step S60 of FIG. 26, in the router connection mode, the external connector 2 has established connection with the wireless LAN router 3 and started communication with the server 5 in step S53. Thus, when operations similar to those in step S110 to step S150 described above are performed, the handheld operation terminal 4 acquires the connection information of the external connector 2, which is the connection information necessary for connection in the router connection mode, and displays the connection information on the display unit 4-4 as illustrated in FIG. 33 (step S61). Here, the connection information of the external connector 2 is the second information registered in the server 5 for operating the device to be controlled 1 by the operation terminal 7 that is the wireless operation terminal.

Then, the operation terminal 7 is used to register the connection information of the external connector 2 displayed on the display unit 4-4 in the server 5 (step S62). Specifically, a user registers the connection information of the external connector 2 displayed on the display unit 4-4 in user registration information, which is the user information registered on the database server 5-2 of the server 5, in association with the user registration information. Note that the connection information of the external connector 2 may be registered in the server 5 using another device. Examples of the connection information of the external connector 2 registered in the server 5 are the MAC address and the ID information specific to the external connector 2.

After step S57 in FIG. 26, as in step S62, the operation terminal 7 is used to register the connection information of the external connector 2 displayed on the display unit 4-4 in the server 5 (step S63). Note that, in this case, the connection information of the external connector 2 displayed on the display unit 4-4 in step S55 need only be registered in the server 5. Alternatively, the operation terminal 7 may acquire the MAC information and the ID information, which are the connection/registration information of the external connector 2 as illustrated in FIG. 21 and are held by the external connector 2 in step S56 in which the operation terminal 7 and the external connector 2 are connected, and may register the acquired connection/registration information of the external connector 2 in the server 5. Yet alternatively, the operation terminal 7 may read the connection information of the external connector 2 displayed on the display unit 4-4 and register the read connection information of the external connector 2 in the server 5.

Figure 34:
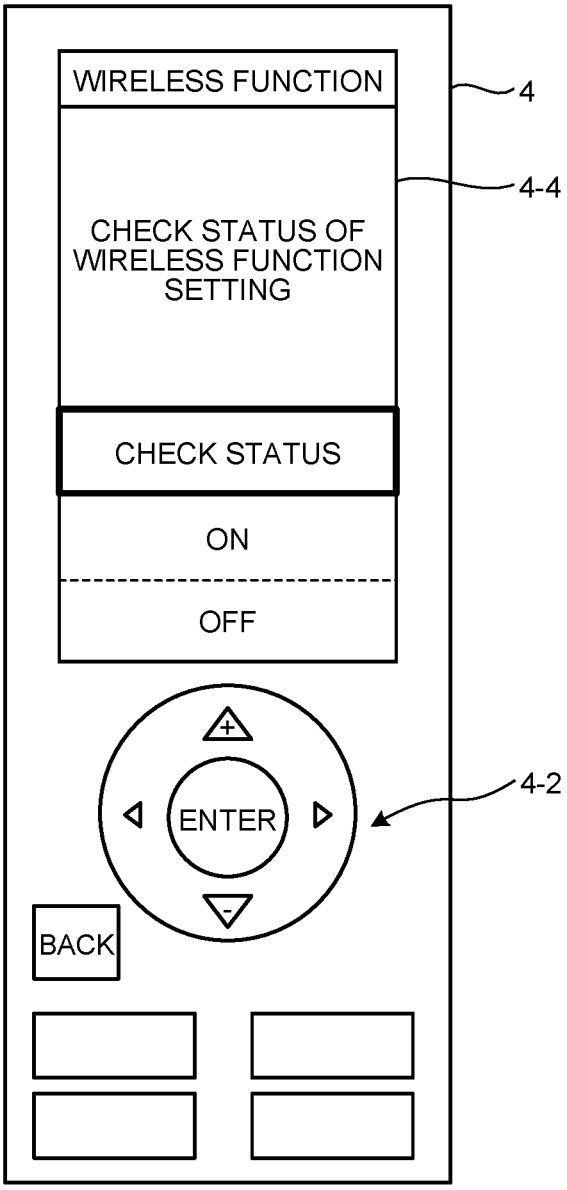
FIG. 34 is a diagram illustrating an example of a display screen for checking and switching a wireless function of the external connector on the display unit of the handheld operation terminal.

FIG. 34 is a diagram illustrating an example of a display screen for checking and switching the wireless function of the external connector on the display unit of the handheld operation terminal. Note that in a case where the external connector 2 is built in the device to be controlled 1, as illustrated in FIG. 34, the handheld operation terminal 4 may set the external connector 2 to an "OFF" state such that radio waves are not emitted at the time of shipment, and may switch the external connector 2 to "ON" by an operation on the operation unit 4-2.

Moreover, the handheld operation terminal 4 may prepare in advance a state checking command for the external connector 2 in the handheld operation terminal controller 4-3 of the handheld operation terminal 4, the state checking command giving an instruction of "status check of the external connector 2" from the operation unit 4-2 to check the status of the external connector 2 such as whether the external connector 2 is in the "ON" or "OFF" state, whether the connection mode of the external connector 2 is the router connection mode or the terminal connection mode, or whether the communication between the external connector 2 and the wireless LAN router 3 is established successfully. Then, when the state checking command for the external connector 2 is operated on the operation unit 4-2 of the handheld operation terminal 4, as in the aforementioned case where the information acquisition request is operated, the handheld operation terminal controller 4-3 controls to connect to the external connector 2 via the device to be controlled communication unit 4-1, acquire desired information as a result of checking, and display the acquired information on the display unit 4-4 of the handheld operation terminal 4.

Moreover, the device control system 100 can acquire the connection/registration information from the handheld operation terminal 4, and thus can ensure security by lowering the communication output level of the handheld operation terminal communication unit 22 and the device to be controlled communication unit 4-1 only when the information acquisition request is operated so that the information cannot be acquired from the outside. That is, the device to be controlled communication unit 4-1 lowers the communication output level when transmitting the information acquisition request for requesting acquisition of information to the handheld operation terminal communication unit 22 after the operation unit 4-2 accepts the operation of the information acquisition request. Moreover, the handheld operation terminal communication unit 22 lowers the communication output level when transmitting, to the device to be controlled communication unit 4-1, information as a response to the information acquisition request received from the device to be controlled communication unit 4-1. This can ensure security in the information communication between the handheld operation terminal communication unit 22 and the device to be controlled communication unit 4-1.

Moreover, although the above description has been made of the case where the handheld operation terminal 4 is the infrared remote control, the handheld operation terminal 4 is not limited to the infrared remote control and may be, for example, a wired remote control that is connected by wire to the external connector 2 or the wireless device 200. The wired remote control may request and acquire the information of a plurality of the devices to be controlled 1 or the external connector 2 collectively, or may request and acquire only the information of a specific one of the device to be controlled 1 or the external connector 2 by, for example, individual identification information corresponding to a state of address switch setting of the device to be controlled 1. The handheld operation terminal 4 may be connected by wire to a plurality of the devices to be controlled 1, designate and acquire the first information or the second information of any of the devices to be controlled 1, and display the first information or the second information acquired on the display unit 4-4. As a result, even in a case where the device control system 100 includes a plurality of the devices to be controlled 1, the aforementioned effects can be obtained.

As described above, the device control system 100 according to the present embodiment includes the switching unit for switching the external connector 2 between the router connection mode that is the first connection mode in which the external connector 2 is wirelessly connected to the operation terminal 7, which is the wireless operation terminal, via the wireless LAN router 3, and the terminal connection mode that is the second connection mode in which the external connector 2 is wirelessly connected directly to the operation terminal 7, which is the wireless operation terminal, without via the wireless LAN router 3.

The switching unit is implemented by the switch 25 of the external connector 2. In a case where the external connector 2 is built in the housing 1*b* of the device to be controlled 1, the switching unit is implemented by the handheld operation terminal 4 and the external connector 2. Specifically, the handheld operation terminal controller 4-3 of the handheld operation terminal 4 includes the mode switching command that is the mode switching request for instructing the external connector 2 to be in the terminal connection mode. When the mode switching command is operated on the operation unit 4-2 of the handheld operation terminal 4, the handheld operation terminal controller 4-3 transmits the mode switching request to the wireless communication unit 2-4 of the external connector 2. The wireless communication unit 2-4 of the external connector 2 receives the mode switching command transmitted from the handheld operation terminal controller 4-3 of the handheld operation terminal 4, and transmits the mode switching command to the connector controller 2-8 of the external connector 2. The connector controller 2-8 receives the mode switching command and performs control to switch the connection mode of the external connector 2 to the terminal connection mode. That is, the handheld operation terminal 4 and the external connector 2 include the function as the switching unit.

When the wireless device 200 receives, from the handheld operation terminal 4, the information acquisition request for the first information that is the information necessary for connecting the operation terminal 7 to the external connector 2, the wireless device 200 selectively transmits the first information to the handheld operation terminal 4, and the display unit 4-4 displays the first information. Also, when the wireless device 200 receives, from the handheld operation terminal 4, the information acquisition request for the second information that is the information registered in the server 5 for operating the device to be controlled 1 by the operation terminal 7, the wireless device 200 selectively transmits the second information to the handheld operation terminal 4, and the display unit 4-4 displays the second information. The handheld operation terminal 4 is configured to display the first information or the second information on the display unit 4-4 in accordance with the connection mode of the external connector 2. As a result, the handheld operation terminal 4 can increase the space for presenting each piece of information displayed on the display unit 4-4, that is, the size of text displayed on the display unit 4-4, thereby improving legibility.

Moreover, in the device control system 100, the handheld operation terminal 4 selectively displays, on the display unit 4-4, the first information that is the information necessary for connecting the operation terminal 7 to the external connector 2 or the second information that is the information registered in the server 5 for operating the device to be controlled 1 by the operation terminal 7, so that when the information is displayed on the display unit 4-4 using the matrix code, the amount of information in the matrix code is reduced, and the code density of the matrix code is reduced, which allows for the use of a member with a reduced resolution of the display unit 4-4.

Moreover, the first information that is the information necessary for connecting the operation terminal 7 to the external connector 2 or the second information that is the information registered in the server 5 for operating the device to be controlled 1 by the operation terminal 7 is selectively displayed on the display unit 4-4 of the handheld operation terminal 4, whereby a user can check the connection/registration information at hand on the handheld operation terminal 4 without looking at the connection/registration information attached to the external connector 2 or the device to be controlled 1 at a high place.

Moreover, in the device control system 100, the handheld operation terminal 4 uses not only text but also the matrix code to display the first information that is the information necessary for connecting the operation terminal 7 to the external connector 2 or the second information that is the information registered in the server 5 for operating the device to be controlled 1 by the operation terminal 7, whereby the information can be recognized by using an imaging device implemented on the operation terminal 7. As a result, a user does not need to manually input the information necessary for registering the external connector 2 in the server 5, and can simplify the registration work.

Moreover, in the device control system 100, the handheld operation terminal 4 displays, on the display unit 4-4, the first information that is the information necessary for connecting the operation terminal 7 to the external connector 2 or the second information that is the information registered in the server 5 for operating the device to be controlled 1 by the operation terminal 7, so that the label indicating the information does not need to be attached to the external connector 2 or the device to be controlled 1, and omission of the label can save material cost of the label and time for label attaching work.

Moreover, the device control system 100 can ensure information security by lowering the communication output level of the handheld operation terminal communication unit 22 and the device to be controlled communication unit 4-1 only when transmitting/receiving information related to the first information that is the information necessary for connecting the operation terminal 7 to the external connector 2 or the second information that is the information registered in the server 5 for operating the device to be controlled 1 by the operation terminal 7. That is, the device control system 100 can ensure information security by lowering the communication output level of the handheld operation terminal communication unit 22 and the device to be controlled communication unit 4-1 only when the handheld operation terminal 4 and the device to be controlled 1 communicate any of the information acquisition request for the first information, the information acquisition request for the second information, the first information, and the second information.

Moreover, in the device control system 100, the handheld operation terminal 4 is directly connected to the wireless device 200 without being connected to the server 5, and thus can be directly connected to the wireless device 200 without being affected by a dynamic change in the IP address.

Therefore, the device control system 100 obtains an effect of being able to display only necessary information on the display unit 4-4 in accordance with a status of the connection mode of the external connector 2.

Figure 35:
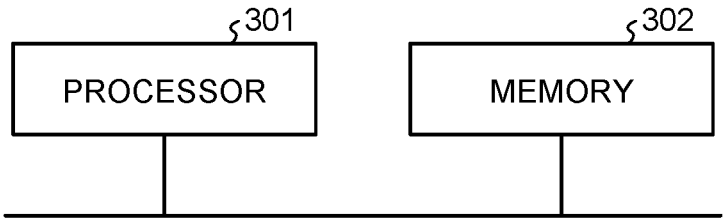
FIG. 35 is a diagram illustrating a processor in a case where functions of each of a controller, a connector controller, and a handheld operation terminal controller according to the embodiment are implemented by the processor.

FIG. 35 is a diagram illustrating a processor in a case where the functions of each of the controller, the connector controller, and the handheld operation terminal controller of the present embodiment described above are implemented by the processor. That is, at least some of the functions of each of the controller 10, the connector controller 2-8, and the handheld operation terminal controller 4-3 may be implemented by a processor 301 that executes a program stored in a memory 302. The processor 301 is a microcomputer, a central processing unit (CPU), a processing unit, an arithmetic unit, a microprocessor, or a digital signal processor (DSP). FIG. 35 also illustrates the memory 302.

In the case where at least some of the functions of each of the controller 10, the connector controller 2-8, and the handheld operation terminal controller 4-3 are implemented by the processor 301, the some of the functions are implemented by the processor 301 and software, firmware, or a combination of software and firmware. The software or firmware is described as a program and stored in the memory 302. The processor 301 reads and executes the program stored in the memory 302, thereby implementing at least some of the functions of each of the controller 10, the connector controller 2-8, and the handheld operation terminal controller 4-3.

That is, in the case where at least some of the functions of each of the controller 10, the connector controller 2-8, and the handheld operation terminal controller 4-3 are implemented by the processor 301, each of the controller 10, the connector controller 2-8, and the handheld operation terminal controller 4-3 includes the memory 302 for storing the program that results in execution of steps executed by at least a part of corresponding ones of the controller 10, the connector controller 2-8, and the handheld operation terminal controller 4-3. It can also be said that the program stored in the memory 302 causes a computer to execute a procedure or method executed by at least a part of each of the controller 10, the connector controller 2-8, and the handheld operation terminal controller 4-3.

The memory 302 includes, for example, a non-volatile or volatile semiconductor memory such as a random access memory (RAM), a read only memory (ROM), a flash memory, an erasable programmable read only memory (EPROM), or an electrically erasable programmable read only memory (EEPROM (registered trademark)), a magnetic disk, a flexible disk, an optical disk, a compact disc, a mini disc, or a digital versatile disk (DVD).

Figure 36:
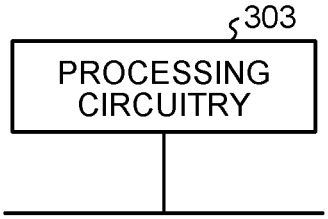
FIG. 36 is a diagram illustrating processing circuitry in a case where at least some of the functions of each of the controller, the connector controller, and the handheld operation terminal controller according to the embodiment are implemented by the processing circuitry.

FIG. 36 is a diagram illustrating processing circuitry in a case where at least some of the functions of each of the controller, the connector controller, and the handheld operation terminal controller according to the present embodiment are implemented by the processing circuitry. That is, at least a part of each of the controller 10, the connector controller 2-8, and the handheld operation terminal controller 4-3 may be implemented by processing circuitry 303.

The processing circuitry 303 is dedicated hardware. The processing circuitry 303 is, for example, a single circuit, a complex circuit, a programmed processor, a parallel-programmed processor, an application specific integrated circuit (ASIC), a field programmable gate array (FPGA), or a combination thereof. A part of the controller 10, the connector controller 2-8, and the handheld operation terminal controller 4-3 may be dedicated hardware separate from the rest.

The configuration illustrated in the above embodiment merely illustrates an example, and thus another known technique can be combined, embodiments can be combined together, or the configuration can be partially omitted and/or modified without departing from the scope of the present disclosure.

The invention claimed is:

1. A device control system comprising:

a wireless device including a device to be controlled and an external connector to be connected to the device to be controlled, transmit/receive information to/from the device to be controlled, and be wirelessly connected to a wireless LAN router;

a handheld operation terminal to operate the device to be controlled, the handheld operation terminal including a display to display information;

a wireless operation terminal to operate the device to be controlled via the external connector, the wireless operation terminal being a terminal different from the handheld operation terminal; and a server to manage the wireless operation terminal that operates the device to be controlled, wherein the wireless device selectively transmits first information to the handheld operation terminal when receiving, from the handheld operation terminal, an information acquisition request for the first information that is information necessary for directly connecting the wireless operation terminal to the external connector and not via the wireless LAN router, and the display displays the first information, and the wireless device selectively transmits second information to the handheld operation terminal when receiving, from the handheld operation terminal, an information acquisition request for the second information that is information to be registered in the server for operating the device to be controlled by the wireless operation terminal via the wireless LAN router, and the display displays the second information.

2. The device control system according to claim 1, wherein the external connector is switchable between a first connection mode and a second connection mode, the first connection mode being a connection mode in which the external connector is wirelessly connected to the wireless operation terminal via the wireless LAN router, and the second connection mode being a connection mode in which the external connector is wirelessly connected directly to the wireless operation terminal without via the wireless LAN router, and the handheld operation terminal displays the first information or the second information on the display in accordance with the connection mode of the external connector.

3. The device control system according to claim 2, wherein the external connector switches the connection mode on the basis of a mode switching request that is a request for switching the connection mode transmitted from the handheld operation terminal, and the handheld operation terminal displays the first information on the display when transmitting the mode switching request to the external connector.

4. The device control system according to claim 1, wherein the wireless operation terminal includes an imaging device, the handheld operation terminal displays the first information or the second information on the display using a matrix code, and the wireless operation terminal reads the matrix code by the imaging device, converts the matrix code into text information, and recognizes the text information.

5. The device control system according to claim 1, wherein the handheld operation terminal and the device to be controlled lower a communication output level when the handheld operation terminal and the device to be controlled communicate any information of the information acquisition request for the first information, the information acquisition request for the second information, the first information, or the second information.

6. The device control system according to claim 1, wherein the handheld operation terminal is connected by wire to a plurality of the devices to be controlled, and displays the first information or the second information of the device to be controlled designated by the handheld operation terminal on the display.

7. A device control system comprising:

a wireless device including a device to be controlled and an external connector to be connected to the device to be controlled, transmit/receive information to/from the device to be controlled, and be wirelessly connected to a wireless LAN router;

a handheld operation terminal to operate the device to be controlled, the handheld operation terminal including a display to display information;

a wireless operation terminal to operate the device to be controlled via the external connector, the wireless operation terminal being a terminal different from the handheld operation terminal; and a server to manage the wireless operation terminal that operates the device to be controlled, wherein the wireless device selectively transmits first information to the handheld operation terminal when receiving, from the handheld operation terminal, an information acquisition request for the first information that is information necessary for connecting the wireless operation terminal to the external connector, the display displays the first information, the wireless device selectively transmits second information to the handheld operation terminal when receiving, from the handheld operation terminal, an information acquisition request for the second information that is information to be registered in the server for operating the device to be controlled by the wireless operation terminal, the display displays the second information, the external connector is switchable between a first connection mode and a second connection mode, the first connection mode being a connection mode in which the external connector is wirelessly connected to the wireless operation terminal via the wireless LAN router, and the second connection mode being a connection mode in which the external connector is wirelessly connected directly to the wireless operation terminal without via the wireless LAN router, and the handheld operation terminal displays the first information or the second information on the display in accordance with the connection mode of the external connector.

8. The device control system according to claim 7, wherein the external connector switches the connection mode on the basis of a mode switching request that is a request for switching the connection mode transmitted from the handheld operation terminal, and the handheld operation terminal displays the first information on the display when transmitting the mode switching request to the external connector.

9. The device control system according to claim 7, wherein the wireless operation terminal includes an imaging device, the handheld operation terminal displays the first information or the second information on the display using a matrix code, and the wireless operation terminal reads the matrix code by the imaging device, converts the matrix code into text information, and recognizes the text information.

10. The device control system according to claim 7, wherein the handheld operation terminal and the device to be controlled lower a communication output level when the handheld operation terminal and the device to be controlled communicate any information of the information acquisition request for the first information, the information acquisition request for the second information, the first information, or the second information.

11. The device control system according to claim 7, wherein the handheld operation terminal is connected by wire to a plurality of the devices to be controlled, and displays the first information or the second information of the device to be controlled designated by the handheld operation terminal on the display.

12. A device control system comprising:

a wireless device including a device to be controlled and an external connector to be connected to the device to be controlled, transmit/receive information to/from the device to be controlled, and be wirelessly connected to a wireless LAN router;

a handheld operation terminal to operate the device to be controlled, the handheld operation terminal including a display to display information;

a wireless operation terminal to operate the device to be controlled via the external connector, the wireless operation terminal being a terminal different from the handheld operation terminal; and a server to manage the wireless operation terminal that operates the device to be controlled, wherein the wireless device selectively transmits first information to the handheld operation terminal when receiving, from the handheld operation terminal, an information acquisition request for the first information that is information necessary for connecting the wireless operation terminal to the external connector, the display displays the first information, the wireless device selectively transmits second information to the handheld operation terminal when receiving, from the handheld operation terminal, an information acquisition request for the second information that is information to be registered in the server for operating the device to be controlled by the wireless operation terminal, the display displays the second information, the wireless operation terminal includes an imaging device, the handheld operation terminal displays the first information or the second information on the display using a matrix code, and the wireless operation terminal reads the matrix code by the imaging device, converts the matrix code into text information, and recognizes the text information.

13. The device control system according to claim 12, wherein the external connector is switchable between a first connection mode and a second connection mode, the first connection mode being a connection mode in which the external connector is wirelessly connected to the wireless operation terminal via the wireless LAN router, and the second connection mode being a connection mode in which the external connector is wirelessly connected directly to the wireless operation terminal without via the wireless LAN router, and the handheld operation terminal displays the first information or the second information on the display in accordance with the connection mode of the external connector.

14. The device control system according to claim 13, wherein the external connector switches the connection mode on the basis of a mode switching request that is a request for switching the connection mode transmitted from the handheld operation terminal, and the handheld operation terminal displays the first information on the display when transmitting the mode switching request to the external connector.

15. The device control system according to claim 12, wherein the handheld operation terminal and the device to be controlled lower a communication output level when the handheld operation terminal and the device to be controlled communicate any information of the information acquisition request for the first information, the information acquisition request for the second information, the first information, or the second information.

16. The device control system according to claim 12, wherein the handheld operation terminal is connected by wire to a plurality of the devices to be controlled, and displays the first information or the second information of the device to be controlled designated by the handheld operation terminal on the display.

* * * * *